US009751100B2

(12) United States Patent
Joseph et al.

(10) Patent No.: US 9,751,100 B2
(45) Date of Patent: Sep. 5, 2017

(54) NOZZLE TIPS AND SPRAY HEAD ASSEMBLIES FOR LIQUID SPRAY GUNS

(75) Inventors: Stephen C. P. Joseph, Woodbury, MN (US); Russell E. Blette, Hastings, MN (US); Erik J. Johnson, Oakdale, MN (US); Arthur V. Lang, Maplewood, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 327 days.

(21) Appl. No.: 13/984,436

(22) PCT Filed: Feb. 8, 2012

(86) PCT No.: PCT/US2012/024234

§ 371 (c)(1),
(2), (4) Date: Aug. 29, 2013

(87) PCT Pub. No.: WO2012/109298

PCT Pub. Date: Aug. 16, 2012

(65) Prior Publication Data

US 2013/0327850 A1 Dec. 12, 2013

Related U.S. Application Data

(60) Provisional application No. 61/440,950, filed on Feb. 9, 2011.

(51) Int. Cl.
*B05B 1/28* (2006.01)
*B05B 7/06* (2006.01)
(Continued)

(52) U.S. Cl.
CPC ..... *B05B 7/065* (2013.01); *B05B 7/067* (2013.01); *B05B 7/083* (2013.01); *B05B 7/0823* (2013.01); *B05B 7/2478* (2013.01)

(58) Field of Classification Search
CPC ..... B05B 7/065; B05B 7/067; B05B 7/0823; B05B 7/083; B05B 7/2478
(Continued)

(56) References Cited

U.S. PATENT DOCUMENTS 1,299,290 A 4/1919 Berg
1,539,536 A 5/1925 Bartling
(Continued)

FOREIGN PATENT DOCUMENTS

CN 1280885 1/2001
CN 2431971 5/2001
(Continued)

OTHER PUBLICATIONS

International Search Report for PCT International Application No. PCT/US2012/024234, Mailed on Apr. 25, 2013, 4 pages.
Ihmels, Manfred, Ihmels Article—SATA, Feb. 15, 1989, 2 pages.

*Primary Examiner* — Justin Jonaitis
(74) *Attorney, Agent, or Firm* — Aleksander Medved

(57) ABSTRACT

Removable nozzle tips, spray head assemblies including the nozzle tips and liquid spray guns that include the nozzle tips are described herein. The removable nozzle tips provide and define both the liquid nozzle openings and the center air outlets for the center air of the liquid spray guns and the spray head assemblies. The nozzle tips are removably attached over a liquid nozzle port formed in the spray head assembly and/or on the spray gun platform or body using any suitable attachment mechanism. The removable nozzle tips can be removed from the liquid spray gun or the spray head assembly without disturbing the remainder of the spray gun or the spray head assembly.

6 Claims, 12 Drawing Sheets

(51) Int. Cl.
*B05B 7/08* (2006.01)
*B05B 7/24* (2006.01)

(58) Field of Classification Search
USPC ..... 239/296, 290, 418, 423, 424, 525, 526, 239/549, 552, 553
See application file for complete search history.

(56) References Cited

U.S. PATENT DOCUMENTS 1,748,440 A 2/1930 Burdick
2,042,746 A 6/1936 Tracy
2,059,706 A 11/1936 Paasche
2,126,888 A 8/1938 Jenkins
2,303,280 A 11/1942 Jenkins
2,362,946 A 11/1944 Stockdale
2,497,625 A 2/1950 Norwick
2,820,670 A 1/1958 Charlop
2,886,252 A 5/1959 Ehrensperger
2,904,262 A 9/1959 Peeps
2,991,940 A 7/1961 Dupler
3,062,453 A 11/1962 Matthews
3,157,360 A 11/1964 Heard
3,168,250 A 2/1965 Paasche
3,236,459 A 2/1966 McRitchie
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A 1/1994 Darroch
5,280,853 A 1/1994 Perret
5,322,221 A 6/1994 Anderson
5,332,156 A 7/1994 Wheeler
5,395,046 A 3/1995 Knobbe
5,454,517 A 10/1995 Naemura
5,456,414 A 10/1995 Burns
5,474,450 A 12/1995 Chronister
5,582,350 A 12/1996 Kosmyna
5,607,108 A * 3/1997 Garlick et al. ..... 239/424
5,609,302 A 3/1997 Smith
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A 5/2000 Ruta
6,068,203 A 5/2000 DeYoung
6,085,996 A * 7/2000 Culbertson et al. ..... 239/290
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,471,144 B1 * 10/2002 Huang ..... B05B 7/0815 239/290
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,237,727 B2 7/2007 Wang
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 2/2009 Joseph
7,694,896 B2 4/2010 Turnbull
D616,527 S 5/2010 Anderson
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 4/2011 Fox
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
8,684,281 B2 4/2014 Micheli
2002/0104898 A1 8/2002 Bonningue
2003/0071144 A1 4/2003 Naemura
2003/0111553 A1 6/2003 Hunter
2003/0173419 A1 9/2003 Huang
2004/0089742 A1 5/2004 Antonucci
2004/0140373 A1 7/2004 Joseph
2004/0195401 A1 10/2004 Strong
2004/0245673 A1 12/2004 Allsop
2004/0256484 A1 12/2004 Joseph
2004/0256493 A1 12/2004 Turnbull
2005/0016448 A1 1/2005 Dilou
2005/0035220 A1 2/2005 Brown
2005/0045741 A1 3/2005 Brown
2005/0087128 A1 4/2005 Jakupovic
2005/0145724 A1 7/2005 Blette
2005/0173561 A1 8/2005 Cotter

(56) References Cited

U.S. PATENT DOCUMENTS

| | | | | |
|---|---|---|---|---|
| 2006/0000927 | A1 | 1/2006 | Ruda | |
| 2006/0065761 | A1 | 3/2006 | Joseph | |
| 2006/0097070 | A1 | 5/2006 | Huffman | |
| 2006/0102550 | A1 | 5/2006 | Joseph | |
| 2006/0175433 | A1 | 8/2006 | Escoto, Jr. | |
| 2006/0186223 | A1 | 8/2006 | Wang | |
| 2007/0102535 | A1 | 5/2007 | Carey | |
| 2007/0262169 | A1* | 11/2007 | Wang | 239/290 |
| 2007/0262172 | A1* | 11/2007 | Huffman | 239/390 |
| 2008/0078849 | A1 | 4/2008 | Fox | |
| 2008/0093479 | A1 | 4/2008 | Delbridge | |
| 2008/0272213 | A1 | 11/2008 | Ting | |
| 2009/0026288 | A1 | 1/2009 | Shih | |
| 2009/0026290 | A1 | 1/2009 | Fox | |
| 2009/0121048 | A1 | 5/2009 | Noshima | |
| 2009/0302133 | A1 | 12/2009 | Micheli | |
| 2010/0108783 | A1 | 5/2010 | Joseph | |
| 2010/0123024 | A1 | 5/2010 | Gohring | |
| 2010/0133358 | A1 | 6/2010 | Goehring | |
| 2010/0187333 | A1 | 7/2010 | Escoto | |
| 2010/0282868 | A1 | 11/2010 | Heigl | |
| 2011/0168811 | A1 | 7/2011 | Fox | |
| 2013/0092760 | A1 | 4/2013 | Joseph | |
| 2013/0327850 | A1 | 12/2013 | Joseph | |
| 2014/0014741 | A1 | 1/2014 | Escoto | |
| 2014/0246519 | A1 | 9/2014 | Johnson | |
| 2015/0028131 | A1 | 1/2015 | Joseph | |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 43 02 911 | 8/1993 |
| DE | 19503495 | 8/1996 |
| DE | 19605227 | 8/1997 |
| DE | 10315426 | 6/2004 |
| DE | 60005536 | 7/2004 |
| DE | 10 2004 027789 | 2/2005 |
| DE | 102004044475 | 12/2005 |
| DE | 10 2007 012989 | 10/2007 |
| DE | 202011050102 | 9/2011 |
| EP | 279992 | 8/1988 |
| EP | 509367 | 10/1992 |
| EP | 0492333 | 3/1995 |
| EP | 0885658 | 12/1998 |
| EP | 1340550 | 9/2003 |
| EP | 1479447 | 11/2004 |
| EP | 1554051 | 4/2006 |
| EP | 1682231 | 7/2006 |
| EP | 1699565 | 6/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H1028906 | 2/1998 |
| JP | 11114458 | 4/1999 |
| JP | 2002-1169 | 1/2002 |
| JP | 2003112086 | 4/2003 |
| JP | 2005211699 | 8/2005 |
| JP | 2007175650 | 7/2007 |
| KR | 10-0435685 | 6/2004 |
| KR | 20-0428831 | 10/2006 |
| NL | 1024774 | 3/2004 |
| RU | 2014906 | 6/1994 |
| RU | 2060383 | 5/1996 |
| SU | 172206 | 1/1965 |
| SU | 1111832 | 9/1984 |
| SU | 1423175 | 9/1988 |
| SU | 1613181 | 12/1990 |
| WO | WO 03/051524 | 6/2003 |
| WO | WO 2004/037432 | 5/2004 |
| WO | WO 2004-037433 | 5/2004 |
| WO | WO 2004/087332 | 10/2004 |
| WO | WO 2005/049145 | 6/2005 |
| WO | WO 2005/063361 | 7/2005 |
| WO | WO 2006-053229 | 5/2006 |
| WO | WO 2006/098623 | 9/2006 |
| WO | WO 2006/107935 | 10/2006 |
| WO | WO 2007/056589 | 5/2007 |
| WO | WO 2007/104967 | 9/2007 |
| WO | WO 2007-139639 | 12/2007 |
| WO | WO 2008/016557 | 2/2008 |
| WO | WO 2012/109298 | 8/2012 |
| WO | WO 2013-016474 | 1/2013 |
| WO | WO 2013/055730 | 4/2013 |
| WO | WO 2015/009475 | 1/2015 |

* cited by examiner

NOZZLE TIPS AND SPRAY HEAD ASSEMBLIES FOR LIQUID SPRAY GUNS

CROSS REFERENCE TO RELATED APPLICATIONS

This application is a national stage filing under 35 U.S.C. 371 of PCT/US2012/024234, filed Feb. 8, 2012, which claims priority to U.S. Provisional Application No. 61/440,950, filed Feb. 9, 2011, the disclosures of which are incorporated by reference in their entireties herein.

Removable nozzle tips, spray head assemblies incorporating the nozzle tips, and liquid spray guns including the nozzle tips are described herein.

Spray apparatus/guns are used in many different locations and facilities to spray liquids for a wide variety of purposes. For example, spray guns are widely used in vehicle body repair shops when spraying a vehicle with liquid coating media, e.g., primer, paint and/or clearcoat. Typically the spray gun includes a body and an integral handle, with a compressed air inlet, air passageways, a liquid nozzle assembly, and a trigger mechanism for releasing the liquid to a nozzle for discharge of the liquid in the form of an atomized spray. During use, the coating media may accumulate on the exterior and interior surfaces of the gun. Unless thoroughly cleaned between operations, dried coating media will accumulate, thereby adversely affecting spraying performance, and possibly contaminating subsequent applications.

Spray head assemblies used with liquid spray guns typically include an air cap and a nozzle tip, both of which are often removable from the liquid spray gun for cleaning and/or to change the spraying properties by, e.g., using an air cap and/or nozzle tip having different characteristics. Typically, however, the air cap of a spray head assembly must be removed with the entire spray head assembly or before the nozzle tip can be removed. That requirement can complicate changes in the nozzle tip to obtain different spray characteristics and/or change or clean clogged nozzle tips, etc., and may, in some instances, require replacement of the entire spray head assembly when only the nozzle tip needs to be changed.

For example, in some designs in which the air cap and nozzle are constructed of molded, solvent resistant plastic, removal of the air cap from the liquid spray gun body may damage the air cap, making its re-use impossible. In other instances, even the potential damage that could be caused by removal of the air cap may result in its replacement in those instances where the cost of potential damage to the air cap far exceeds the cost of merely replacing it along with the nozzle as a precautionary measure.

SUMMARY

Removable nozzle tips, spray head assemblies including the nozzle tips, and liquid spray guns that include the nozzle tips are described herein. In some embodiments, the removable nozzle tips may be constructed of a molded plastic and include features designed to deliver both air and the liquid to be sprayed in a manner that results in an acceptable spray coating.

The removable nozzle tips described herein provide and define both the liquid nozzle openings and the center air outlets for the center air of the spray head assemblies described herein. The nozzle tips are removably attached over a liquid nozzle port formed in the spray head assembly and/or on the spray gun platform using any suitable attachment mechanism. In addition, the removable nozzle tips are designed to be removed from the spray head assembly while the remainder of the spray head assembly remains assembled and attached to the liquid spray gun platform. As a result, the removable nozzle tips of the spray head assemblies described herein can preferably be removed for cleaning and/or replacement without requiring removal or detachment of the air cap from the barrel or spray gun platform.

By offering a user the ability to change nozzle tips during use without requiring disassembly of the remainder of the spray head assembly, changes between different nozzle tips having different spray characteristics can be more easily performed as compared to spray head assemblies that require removal of at least the air cap and, in some instances, removal of the barrel as well (particularly in those assemblies in which the nozzle opening is integral with the barrel).

As used herein, a "removable" nozzle tip is a nozzle tip that can be removed from a nozzle port to which it is attached without damaging the nozzle port such that a different nozzle tip could be attached to the nozzle port and function properly when so attached. In some embodiments, the removable nozzle tip itself may be damaged by removal from a nozzle port such that it cannot be reliably re-used, while, in other embodiments, the nozzle tip itself may not be damaged by removal from the nozzle port such that it can be reliably re-used on the same or a different spray head assembly.

In one aspect, some embodiments of a nozzle tip for a spray head assembly in a liquid spray gun as described herein (where the spray head assembly includes a body, an air cap attached to the body, and a nozzle port) may include a liquid nozzle opening through which liquid exits during operation of the liquid spray gun and a center air outlet through which center air discharges when a liquid is sprayed through the nozzle tip. The nozzle tip is removably attached to the spray head assembly over the nozzle port and, further, the nozzle tip can be disengaged from the spray head assembly while the air cap remains attached to the body. In some embodiments of this aspect, the nozzle tip is removably attached to the body of the spray head assembly. In some embodiments of this aspect, the nozzle tip is removably attached to the air cap. In some embodiments of this aspect, the dimensions of the liquid nozzle opening and the center air outlet are fixed within the nozzle tip.

In another aspect, some embodiments of a nozzle tip for a liquid spray gun as described herein (where the liquid spray gun includes a nozzle port and an air cap attached to the liquid spray gun over the nozzle port) may include a liquid nozzle opening through which liquid exits during operation of the liquid spray gun and a center air outlet through which center air discharges when a liquid is sprayed through the nozzle tip. The nozzle tip is removably attached to the liquid spray gun over the nozzle port and, further, the nozzle tip can be disengaged from the liquid spray gun while the air cap remains attached to the liquid spray gun. In some embodiments of this aspect, the nozzle tip is removably attached to a body of the liquid spray gun. In some embodiments of this aspect, the nozzle tip is removably attached to the air cap. In some embodiments of this aspect, the dimensions of the liquid nozzle opening and the center air outlet are fixed within the nozzle tip.

In another aspect, some embodiments of kits as described herein may include a plurality of nozzle tips of either of the two aspects described above. In some embodiments of the kits, two of the nozzle tips comprise center air outlets having different dimensions. In some embodiments of the kits, at least two of the nozzle tips comprise liquid nozzle openings having different dimensions.

In another aspect, a liquid spray gun as described herein may include, in some embodiments: a liquid spray gun body comprising a nozzle port; an air cap attached to the liquid spray gun body, wherein the air cap is positioned over the nozzle port; and a nozzle tip removably attached to the liquid spray gun over the nozzle port such that the nozzle tip is in fluid-tight communication with the nozzle port, wherein the nozzle tip comprises a liquid nozzle opening through which liquid exits during operation of the liquid spray gun, and a center air outlet through which center air discharges when a liquid is sprayed through the nozzle tip. In this aspect, the nozzle tip can be disengaged from the liquid spray gun while the air cap remains attached to the liquid spray gun body. In some embodiments of this aspect, the nozzle tip is removably attached to the liquid spray gun body. In some embodiments of this aspect, the nozzle tip is removably attached to the air cap. In some embodiments of this aspect, the dimensions of the liquid nozzle opening and the center air outlet are fixed within the nozzle tip.

In another aspect, a nozzle tip for a liquid spray gun is described herein. The liquid spray gun includes an air cap attached to the liquid spray gun, and wherein the liquid spray gun includes a liquid supply passage through which liquid passes during spraying and at least one air supply passage through which air passes during spraying. In some embodiments, the nozzle tip comprises: a nozzle body comprising an inlet end and a nozzle outlet end; a liquid nozzle opening formed in the nozzle outlet end of the nozzle body; a nozzle passage inlet formed in the nozzle body; a nozzle passage extending through the nozzle body from the nozzle passage inlet to the liquid nozzle opening, wherein liquid entering the nozzle passage through the nozzle passage inlet leaves the nozzle tip through the liquid nozzle opening after passing through the nozzle passage; and a flange attached to the nozzle body proximate the nozzle outlet end, wherein the flange comprises an internal surface that faces the inlet end of the nozzle body and an external surface that faces away from the inlet end of the nozzle body, wherein a nozzle tip portion of a center air chamber is defined between the internal surface of the flange and the nozzle body. A flange aperture extends through the internal and external surfaces of the flange, wherein the flange aperture is larger than the nozzle outlet end of the nozzle body; and wherein the nozzle outlet end of the nozzle body is located in the flange aperture such that the flange aperture and the nozzle outlet end of the nozzle body define a gap therebetween, and further wherein the gap forms a center air outlet in the nozzle tip such that air entering the nozzle tip portion of the center air chamber passes through the center air outlet around the nozzle outlet end of the nozzle body. The nozzle passage in the nozzle body and the nozzle tip portion of the center air chamber are independent of each other and the nozzle passage inlet forms a liquid-tight connection with a liquid supply passage of a liquid spray gun when the nozzle tip is attached to the liquid spray gun.

Various embodiments of the nozzle tips described in connection with the previous aspect may include one or more of the following features: the nozzle body comprises a threaded connection at the inlet end of the nozzle body; the flange is attached to the nozzle body by one or more support members extending from the nozzle body to the flange; the center air opening is in the form of a circular slot located between the flange aperture and the nozzle outlet end of the nozzle body; the nozzle body comprises a nozzle sealing surface proximate the inlet end of the nozzle body; the flange comprises a flange sealing surface proximate an outer edge of the flange; the flange comprises an outer edge, and wherein, when the nozzle tip is attached to a liquid spray gun that includes an air cap, the outer edge of the flange forms a seal with a portion of the air cap; the flange comprises one or more interlocking engagement features on the external surface of the flange, wherein the nozzle tip can be rotated about an axis extending through the liquid nozzle opening (optionally by a tool engaging the interlocking engagement features); the nozzle body and the flange are formed as an integral, one-piece component; the nozzle body and the flange are formed of a polymeric material; the nozzle outlet end, the liquid nozzle opening, and the center air outlet are shaped to direct air under greater than atmospheric pressure against liquid flowing out of the liquid nozzle opening; etc.

In another aspect, the nozzle tips described herein may be provided as a part of a kit that includes a plurality of nozzle tips, wherein at least two nozzle tips of the plurality of nozzle tips comprise center air outlets having different dimensions. In some embodiments of the kits, at least two nozzle tips of the plurality of nozzle tips comprise liquid nozzle openings having different dimensions. In some embodiments of the kits, at least two nozzle tips of the plurality of nozzle tips comprise liquid nozzle openings having different dimensions and center air outlets having different dimensions. In some embodiments of the kits, each nozzle tip of the plurality of nozzle tips comprises a threaded connection at the inlet end of the nozzle body.

In another aspect, a spray head assembly for attachment to a liquid spray gun platform as described herein may include, in some embodiments, a barrel, an air cap attached to the barrel, and a nozzle tip attached to a nozzle port on the barrel. The spray head assembly further comprises a liquid supply passage in the barrel, wherein the liquid supply passage extends from an inlet end in the barrel to the nozzle port; a center air chamber that extends from a barrel inlet to a center air outlet in the nozzle tip, wherein the center air chamber comprises a nozzle cavity located between the air cap and the barrel, a barrel cavity located within the barrel, and a plurality of openings formed in the barrel through which air passes into the nozzle cavity from the barrel cavity for delivery to the center air outlet during use of the spray head assembly. The nozzle tip comprises a nozzle body comprising an inlet end and a nozzle outlet end; a liquid nozzle opening formed in the nozzle outlet end of the nozzle body; a nozzle passage inlet formed in the nozzle body; a nozzle passage extending through the nozzle body from the nozzle passage inlet to the liquid nozzle opening, wherein liquid entering the nozzle passage through the nozzle passage inlet leaves the nozzle tip through the liquid nozzle opening after passing through the nozzle passage; and a flange attached to an exterior surface of the nozzle body proximate the nozzle outlet end, wherein the flange comprises a flange aperture that is larger than the nozzle outlet end of the nozzle body. The nozzle outlet end of the nozzle body is located in the flange aperture such that the flange aperture and the nozzle outlet end of the nozzle body define a gap therebetween, and further wherein the gap forms the center air outlet in the nozzle tip. The air cap includes a nozzle tip opening, wherein the flange of the nozzle tip closes the nozzle tip opening of the air cap such that air leaving the center air chamber is directed through the center air outlet of the nozzle tip when the nozzle tip is attached to the barrel. The nozzle tip can be detached from the nozzle port of the barrel while the air cap remains attached to the barrel.

Various embodiments of the spray head assemblies described in connection with the previous aspect may include one or more of the following features: the flange comprises an outer edge, and wherein the outer edge of the flange forms a seal with an inner edge of the nozzle tip opening in the air cap when the nozzle tip and the air cap are attached to the spray head assembly; the nozzle tip is attached to the barrel such that the nozzle passage inlet is positioned over the nozzle port; the nozzle tip is attached to the air cap such that the nozzle passage inlet is positioned over the nozzle port; the flange is attached to the nozzle body by one or more support members extending from the nozzle body to the flange; the gap formed by the nozzle outlet end and the flange aperture comprises a circular gap; the nozzle body comprises a nozzle sealing surface proximate the nozzle passage inlet, wherein the nozzle sealing surface forms a liquid tight seal with the nozzle port on the barrel when the nozzle tip is attached to the spray head assembly; an outer edge of the flange forms a seal with an inner edge of the nozzle tip opening when the nozzle tip is attached to the spray head assembly; the flange comprises an external surface facing away from the nozzle body, wherein one or more interlocking engagement features are formed on the external surface of the flange, wherein the nozzle tip can be rotated about an axis extending through the liquid nozzle opening (optionally by a tool engaging the interlocking engagement features); the nozzle body and the flange are formed as an integral, one-piece component; the nozzle body and the flange are formed of a polymeric material; the nozzle outlet end, the liquid nozzle opening, and the center air outlet are shaped to direct air under greater than atmospheric pressure against liquid flowing out of the liquid nozzle opening; the air cap comprises two air horns, and wherein the air cap, when attached to the barrel, defines a fan control air chamber that extends from an inlet end of a fan air barrel passage formed in the barrel to apertures located on air horns projecting past the liquid nozzle opening, wherein the apertures in the air horns are located on opposite sides of an axis extending through the liquid nozzle opening such that air flowing out of the fan control air chamber through the apertures on the air horns under greater than atmospheric pressure flows against opposite sides of a stream of liquid exiting the liquid nozzle opening; etc.

In another aspect, a spray head assembly for attachment to a liquid spray gun platform, as described herein may, in some embodiments, include a barrel adaptor, an air cap, and a nozzle tip removably attached to the spray head assembly over a nozzle port on the barrel adaptor. The spray head assembly may also include a liquid supply passage in the barrel adaptor, wherein the liquid supply passage extends from an inlet end in the barrel to the nozzle port. The nozzle tip may include a nozzle body comprising an inlet end and a nozzle outlet end; a liquid nozzle opening formed in the nozzle outlet end of the nozzle body; a nozzle passage inlet formed in the nozzle body; a nozzle passage extending through the nozzle body from the nozzle passage inlet to the liquid nozzle opening, wherein liquid entering the nozzle passage through the nozzle passage inlet leaves the nozzle tip through the liquid nozzle opening after passing through the nozzle passage; and a flange attached to an exterior surface of the nozzle body proximate the nozzle outlet end, wherein the flange comprises a flange aperture that is larger than the nozzle outlet end of the nozzle body. The nozzle outlet end of the nozzle body is located in the flange aperture such that the flange aperture and the nozzle outlet end of the nozzle body define a gap therebetween, and further wherein the gap forms the center air outlet in the nozzle tip. The air cap includes a nozzle tip opening, wherein the flange of the nozzle tip closes the nozzle tip opening of the air cap except for the center air outlet in the nozzle tip when the nozzle tip is attached to the spray head assembly. The nozzle tip can be detached from the spray head assembly while the barrel adaptor and the air cap remain attached to a spray gun.

Various embodiments of the spray head assemblies described in connection with the previous aspect may include one or more of the following features: the flange comprises an outer edge, and wherein the outer edge of the flange forms a seal with an inner edge of the nozzle tip opening in the air cap when the nozzle tip is attached to the spray head assembly and the air cap is attached to a spray gun over the barrel adaptor; the nozzle tip is attached to the barrel adaptor such that the nozzle passage inlet is positioned over the nozzle port; the nozzle tip is attached to the air cap such that the nozzle passage inlet is positioned over the nozzle port; the flange is attached to the nozzle body by one or more support members extending from the nozzle body to the flange; the gap formed by the nozzle outlet end and the flange aperture comprises a circular gap; the nozzle body comprises a nozzle sealing surface proximate the nozzle passage inlet, wherein the nozzle sealing surface forms a liquid tight seal with the nozzle port on the barrel adaptor when the nozzle tip is attached to the spray head assembly; an outer edge of the flange forms a seal with an inner edge of the nozzle tip opening when the nozzle tip is attached to the spray head assembly over the nozzle port; the flange comprises an external surface facing away from the nozzle body, wherein one or more interlocking engagement features are formed on the external surface of the flange, wherein the nozzle tip can be rotated about an axis extending through the liquid nozzle opening (optionally by a tool engaging the interlocking engagement features); the nozzle body and the flange are formed of a polymeric material; the nozzle outlet end, the liquid nozzle opening, and the center air outlet are shaped to direct air under greater than atmospheric pressure against liquid flowing out of the liquid nozzle opening; the air cap comprises two air horns comprising cavities formed therein and apertures located on air horns projecting past the liquid nozzle opening, wherein the apertures in the horns are located on opposite sides of an axis extending through the liquid nozzle opening such that air flowing out of the apertures on the air horns under greater than atmospheric pressure flows against opposite sides of a stream of liquid exiting the liquid nozzle opening; etc.

In another aspect, the spray head assemblies described herein may be provided as a part of a kit that includes a plurality of the nozzle tips, wherein at least two nozzle tips of the plurality of nozzle tips comprise center air outlets having different dimensions. In some embodiments of the kits, at least two nozzle tips of the plurality of nozzle tips comprise liquid nozzle openings having different dimensions. In some embodiments of the kits, at least two nozzle tips of the plurality of nozzle tips comprise liquid nozzle openings having different dimensions and center air outlets having different dimensions. In some embodiments of the kits, each nozzle tip of the plurality of nozzle tips comprises a threaded connection at the inlet end of the nozzle body.

In another aspect, the nozzle tip described herein may comprise a spray axis and a nozzle body comprising a nozzle outlet end and a liquid nozzle opening surrounding the spray axis. In some embodiments of the nozzle tips, the nozzle tip comprises a flange attached to the nozzle body by a support member, the flange comprising a flange aperture surrounding the spray axis and surrounding the nozzle outlet end such that a center air outlet is defined between the flange aperture and the nozzle outlet end. In some embodiments of the nozzle tips, the center air outlet and the liquid nozzle opening are fixed in relation to one another about the spray axis.

Various embodiments of the nozzle tips described in connection with the previous aspect may include one or more of the following features: the nozzle tip is an integral, one piece nozzle tip; the nozzle outlet end comprises a cylinder and the flange aperture is circular, such that the center air outlet is an annulus, the center air outlet and the liquid nozzle opening being fixed in concentric relation to one another about the spray axis.

In another aspect, methods of making nozzle tips as described herein include introducing a molten material to a mold. In some embodiments, the methods comprise forming, with the molten material in the mold, a spray axis, a nozzle body comprising a nozzle outlet end and a liquid nozzle opening surrounding the spray axis. In some embodiments, the methods comprise forming, with the molten material in the mold, a flange attached to the nozzle body by a support member, the flange comprising a flange aperture surrounding the spray axis and surrounding the nozzle outlet end such that a center air outlet is defined between the flange aperture and the nozzle outlet end. In some embodiments, the methods comprise cooling the formed molten material to make a nozzle tip wherein the center air outlet and the liquid nozzle opening are fixed in relation to one another about the spray axis.

Various embodiments of the methods of making nozzle tips described in connection with the previous aspect may include one or more of the following features: the nozzle tip is an integral, one piece nozzle tip; cooling the formed molten material to make an integral, one piece nozzle tip wherein the center air outlet and the liquid nozzle opening are fixed in relation to one another about the spray axis; the nozzle outlet end comprises a cylinder and the flange aperture is circular, such that the center air outlet is formed as an annulus, wherein, upon cooling, the center air outlet and the liquid nozzle opening are fixed in concentric relation to one another about the spray axis; the molten material comprises a polymer; and, the molten material comprises a metal.

As used herein, the term "liquid" refers to all forms of flowable materials that can be applied to a surface using a spray gun or other spray apparatus (whether or not they are intended to color the surface) including (without limitation) paints, primers, base coats, lacquers, varnishes and similar paint-like materials, as well as other materials such as, e.g., adhesives, sealers, fillers, putties, powder coatings, blasting powders, abrasive slurries, agricultural liquids/solutions (e.g., fertilizers, herbicides, insecticides, etc.), mold release agents, foundry dressings, etc. which may, in some embodiments, be applied in atomized form depending on the properties and/or the intended application of the material. The term "liquid" is to be construed accordingly.

The words "preferred" and "preferably" refer to embodiments of the nozzle tips, spray head assemblies, liquid spray guns, and other components described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

The above summary is not intended to describe each embodiment or every implementation of the nozzle tips, spray head assemblies, and liquid spray gun systems described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
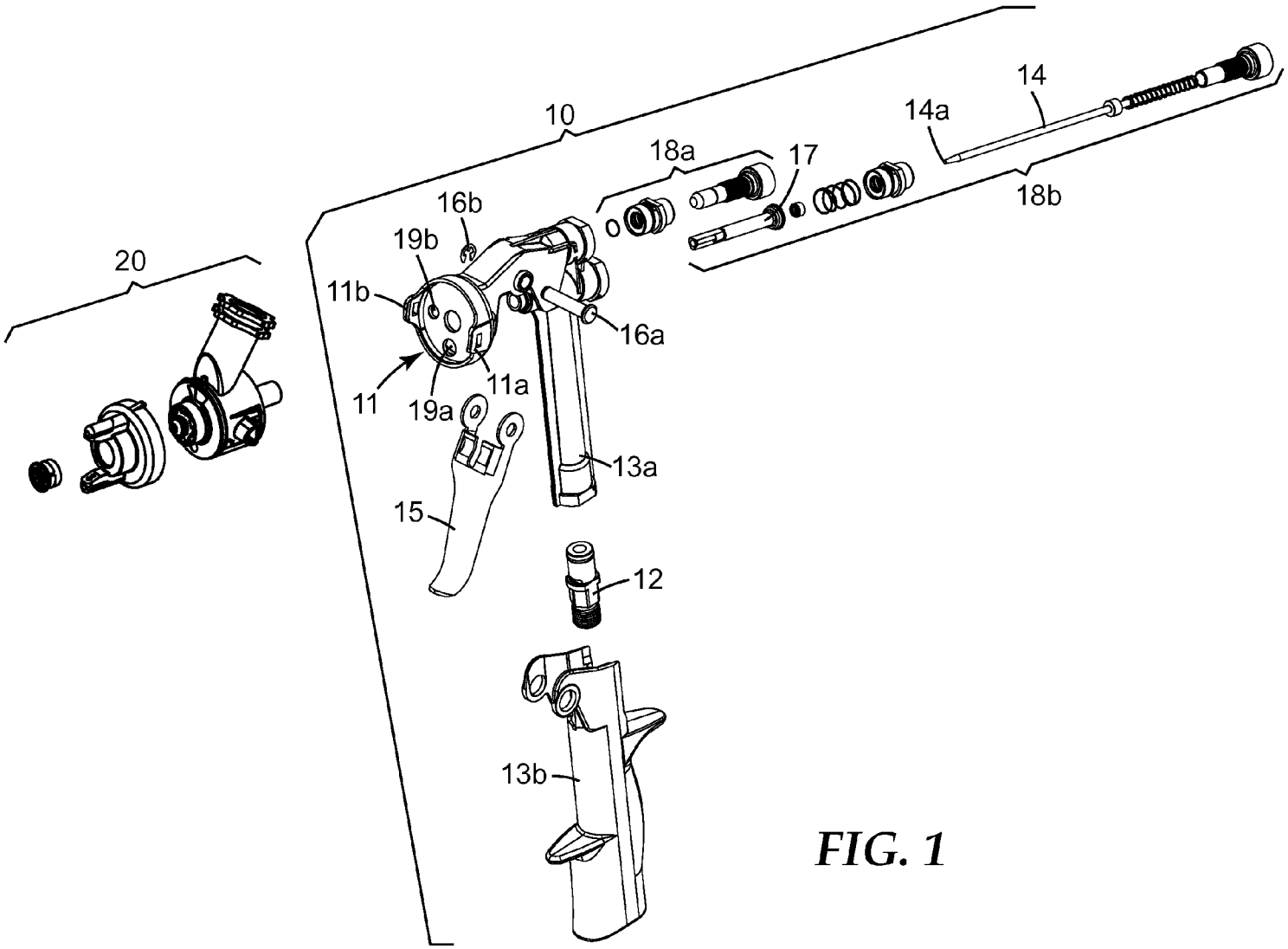
FIG. 1 is an exploded perspective view of one illustrative embodiment of a liquid spray gun as described herein.

In the following detailed description of illustrative embodiments of the liquid spray guns and components, reference is made to the accompanying figures of the drawing which form a part hereof, and in which are shown, by way of illustration, specific embodiments in which the liquid spray guns and components described herein may be practiced. It is to be understood that other embodiments may be utilized and structural changes may be made without departing from the scope of the present invention.

The nozzle tips and/or spray head assemblies described herein are preferably constructed to receive air from the center air passages of liquid spray guns or liquid spray gun platforms to which they are attached. The spray head assemblies may, in some embodiments, include fan air chambers that receive fan air from a fan air passage in the attached spray gun platforms in addition to center air chambers that receive center air from a center air passage in the attached spray gun platforms.

Although described herein in combination with each other, the nozzle tips and spray head assemblies described herein that include barrels may each be used separately with other components to provide a liquid spray gun. For example, the liquid spray gun platforms described herein could be used with any spray head assembly that was designed to operably connect to a barrel interface of the liquid spray gun platform. Similarly, the spray head assemblies could be used with other liquid spray gun platforms that have a barrel interface designed to accept the spray head assemblies described herein.

The liquid spray guns, spray gun platforms, and spray head assemblies described herein may be used in a liquid spray delivery system in which a container of liquid to be dispensed is mounted on the liquid spray gun, although in other embodiments liquid could be supplied from other sources that may, e.g., be connected to the liquid spray gun by, e.g., a supply line, etc. The liquid spray guns, spray guns described herein may preferably be sized for use as a hand-held spray gun and may be used in methods that involve the spraying of one or more selected liquids.

In embodiments that use a liquid container mounted on the spray gun itself, the liquid container may preferably be mounted on and detached from the spray head assembly, which is also preferably attached to and detachable from the spray gun platform. By connecting the container to the spray head assembly and arranging for the spray head assembly to be detachable from the spray gun platform, liquid withdrawn from the container in use is delivered to a nozzle in the spray head assembly without passing through the spray gun platform. In this way, the extent to which the spray gun platform is contaminated by the liquid media, and the amount of cleaning required on completion of spraying or when changing over the spray gun to spray another media, may be reduced.

The nozzle tips and spray head assemblies described herein are adapted to atomize a liquid to form a spray. For example, the nozzle tip and spray head assembly may be arranged to mix the liquid emerging from a nozzle with a supply of compressed air. In some embodiments, liquid emerging from the nozzle tip can be further mixed with air streams directed onto the liquid from two sides to further atomize the liquid and/or shape the spray pattern. The air streams may be adjusted to adapt the spray head assembly for dispensing different media. Although many embodiments of the spray head assemblies described herein are provided as a composite article formed using a barrel and an air cap assembled on the barrel, in other embodiments, the spray head assemblies may include only an air cap and a nozzle tip.

Although the illustrative embodiments described herein include optional air horns to provide air streams that can be directed onto the liquid emerging from the nozzle tip from two or more sides, spray head assemblies as described herein may or may not include air horns or any other structures configured to provide air streams that can be directed onto the liquid emerging from the nozzle tip from two or more sides.

In some embodiments (some illustrative examples of which are described in more detail below), the nozzle tips described herein are adapted for use in a spray head assembly that can be attached to a liquid spray gun. The spray head assembly itself includes a body (e.g., a barrel), an air cap attached to the body, and a nozzle port. The nozzle tip includes a liquid nozzle opening through which liquid exits during operation of the liquid spray gun and a center air outlet through which center air discharges when a liquid is sprayed through the nozzle tip.

The nozzle tip is removably attached to the spray head assembly over the nozzle port such that liquid passing through the nozzle port passes into the nozzle tip before exiting through the liquid nozzle opening of the nozzle tip. In addition, the nozzle tip can be disengaged from the spray head assembly while the air cap remains attached to the body, such that, as discussed herein, the nozzle tips can be changed without disturbing the remainder of the liquid spray gun. The nozzle tip may be removably attached to the body and/or the air cap. Because the nozzle tip defines the liquid nozzle opening and the center air outlet, the dimensions of both the liquid nozzle opening and the center air outlet are fixed entirely within the nozzle tip (as opposed to conventional spray head assemblies in which the air cap defines, at least in part, the dimensions of the center air outlet).

By fixing the dimensions of both the liquid nozzle opening and the center air outlet entirely within the nozzle tip as indicated above, certain advantages may be realized. For example, fixing such dimensions about the spray axis 100 can prevent potential misalignment of the liquid nozzle opening and the center air outlet that can lead to improper or unpredictable atomization of the liquid, and therefore undesirable spray patterns. Such misalignment might otherwise be caused by, for example, improper assembly of individual parts such that appropriate alignment is not achieved, or by one or more defective individual parts that are not capable of achieving appropriate alignment. By way of example, it may be desirable in some systems to maintain the liquid nozzle opening and the center air outlet in aligned, concentric relation to one another about the spray axis such that the center air fully and evenly surrounds the liquid during spraying. If, as in a conventional spray gun, a separate air cap and liquid nozzle are assembled to form the center air outlet, then a geometric defect in either part (e.g., slightly out of round, or a hole slightly off axis) may cause a corresponding defect in the finished assembly, leading to undesired spray patterns. Such undesirable affects can be avoided by nozzle tips according to the present disclosure.

Figure 5:
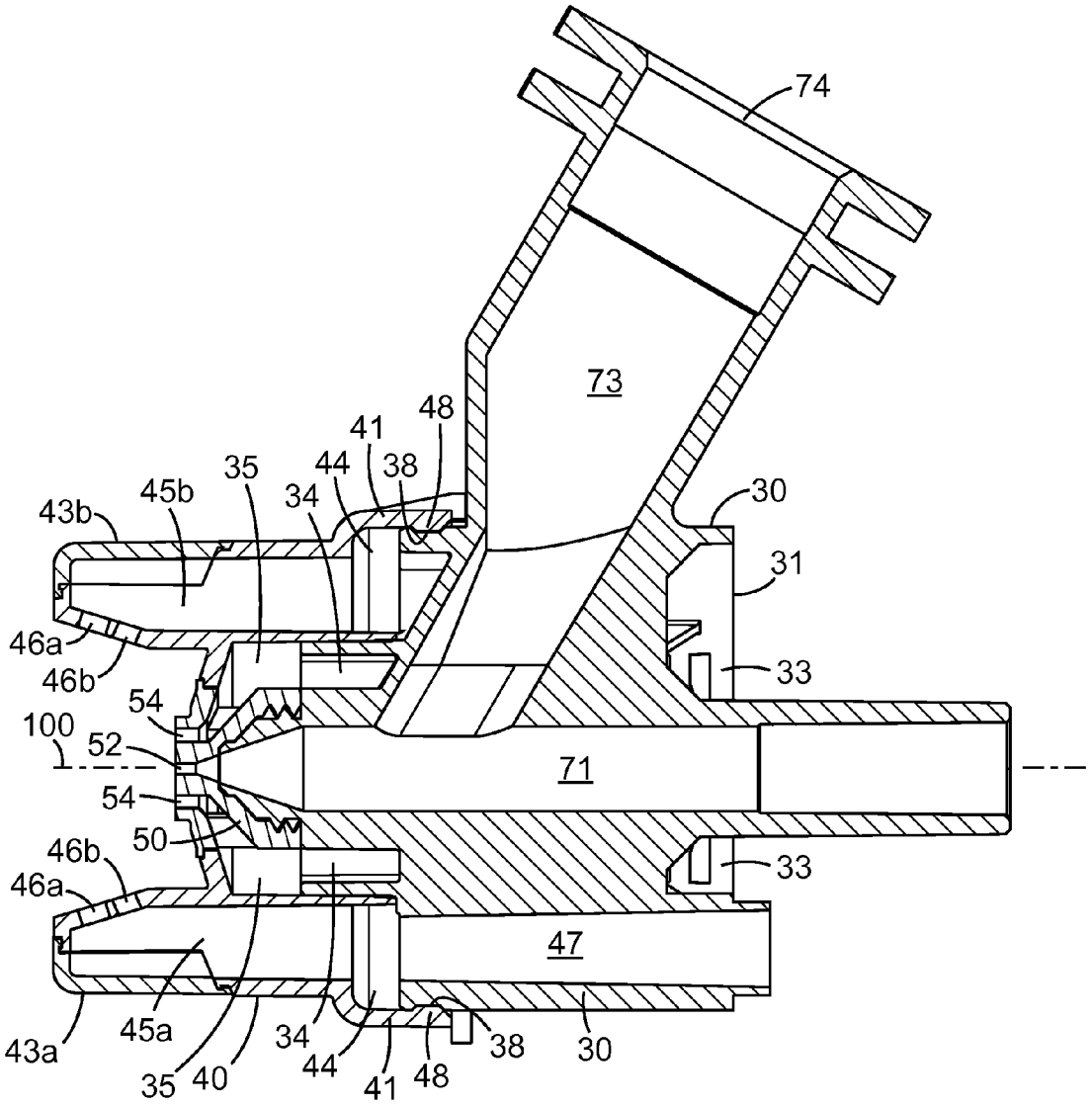
FIG. 5 is a cross-sectional view of the of the spray head assembly of FIGS. 3 and 4, with the air cap 40 rotated ninety degrees relative to the view depicted in FIG. 4.
Figure 6:
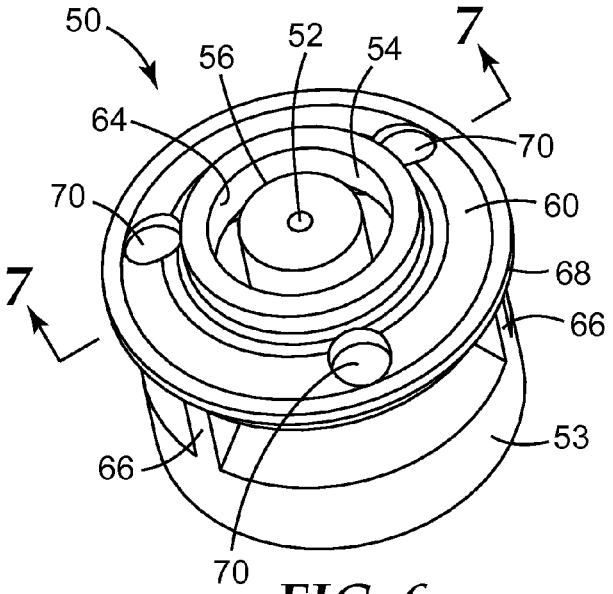
FIG. 6 is a top perspective view of one illustrative embodiment of a nozzle tip as described herein.
Figure 7:
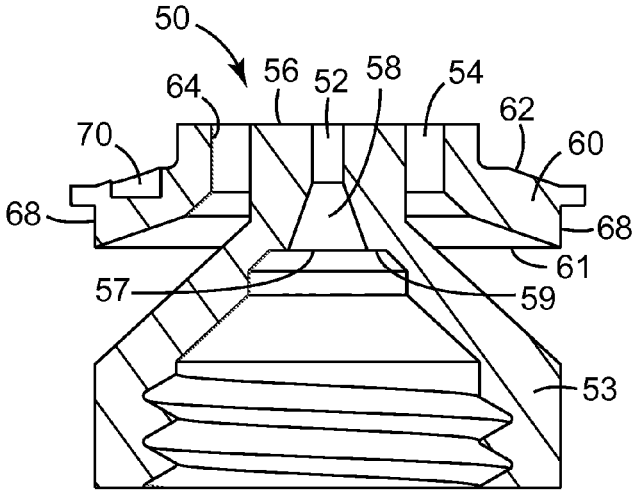
FIG. 7 is a cross-sectional view of the nozzle tip of FIG. 6 taken along line 7-7 in FIG. 6.
Figure 8:
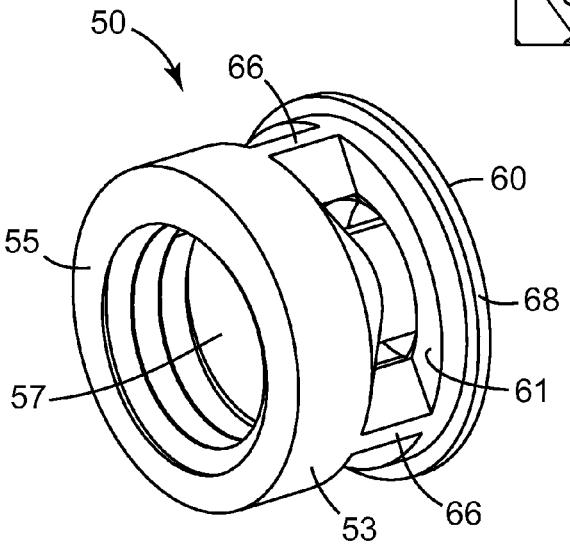
FIG. 8 is a bottom perspective view of the nozzle tip of FIGS. 6-7.

As depicted, for example, in FIGS. 6-8, a nozzle tip 50 may comprise a spray axis 100 (as shown e.g., in FIG. 5) and a nozzle body 53 comprising a nozzle outlet end 56 and a liquid nozzle opening 52 surrounding the spray axis. As depicted, the nozzle tip comprises a flange 60 attached to the nozzle body by a support member 66, the flange comprising a flange aperture 64 surrounding the spray axis and surrounding the nozzle outlet end such that a center air outlet 54 is defined between the flange aperture and the nozzle outlet end. As can be seen, the center air outlet and the liquid nozzle opening are fixed in relation to one another about the spray axis. Nozzle tips as shown may be provided as integral, one piece nozzle tips. In some embodiments, the nozzle outlet end comprises a cylinder (see, e.g., cylindrical protrusion extending through the flange aperture 64 in FIG. 7, terminating in the leader line for reference number 56) and the flange aperture 64 is circular, such that the center air outlet is an annulus, the center air outlet and the liquid nozzle opening being fixed in concentric relation to one another about the spray axis.

It should be noted that, although the appended Figures (e.g., FIGS. 5 and 7) depict a nozzle outlet end 56 having a protruding end that is flush with flange aperture 64, it may be advantageous to alter such geometry such that the nozzle outlet end is slightly recessed within, or is proud of, the flange aperture 64. Such alterations can assist in tailoring the atomization and flow characteristics of the nozzle tip for a given liquid to be sprayed, and are thus within the scope of the present disclosure.

Moreover, fixing the dimensions of both the liquid nozzle opening and the center air outlet entirely within the nozzle tip as indicated above may provide certain advantages in manufacturing. For example, nozzle tips as described herein may be molded (e.g., by injection molding) as a single, integral part and, if desired, in a single shot. In embodiments of such manufacturing methods, a molten polymer can be introduced into a mold cavity, whereupon the molten polymer can flow to fill the cavity and take on the shape of the finished nozzle tip. Such shaped, molten polymer may then be cooled to form a nozzle tip having a liquid nozzle opening and center air outlet in fixed relation to one another, whereby proper registration of such features can be carefully controlled by design of the mold and exactly reproduced with each mold cycle. For example, the nozzle tips depicted in FIGS. 5-8 may be made according to the above-described molding methods. In particular, methods disclosed herein include introducing a molten polymeric material to a mold (not shown), forming, with the molten polymeric material in the mold, a spray axis 100, a nozzle body 53 comprising a nozzle outlet end 56 and a liquid nozzle opening 52 surrounding the spray axis. In one embodiment, further formed in the mold is a flange 60 attached to the nozzle body by a support member 66, the flange comprising a flange aperture 64 surrounding the spray axis and surrounding the nozzle outlet end such that a center air outlet 54 is defined between the flange aperture and the nozzle outlet end. The formed, molten polymeric material is then cooled to make a nozzle tip wherein the center air outlet and the liquid nozzle opening are fixed in relation to one another about the spray axis. As described above, nozzle tips as shown may be molded as integral, one piece nozzle tips. In some embodiments, the nozzle tip is molded such that the nozzle outlet end comprises a cylinder (see, e.g., cylindrical protrusion extending through the flange aperture 64 in FIG. 7, terminating in the leader line for reference number 56) and the flange aperture 64 is circular, such that the center air outlet is an annulus, the center air outlet and the liquid nozzle opening in the cooled nozzle tip being fixed in concentric relation to one another about the spray axis. Another exemplary manufacturing method for nozzle tips according to the present disclosure is casting, such as investment casting. In certain applications, such as spraying of abrasive slurries, it may be desirable to provide nozzle tips comprising materials with increased abrasion resistance. Such materials may include, for example, metals such as aluminum, copper, or steel, including combinations and/or alloys thereof, glass, or ceramic, including optionally in combination with additives as may be beneficial toward forming an abrasion resistant part. For example, nozzle tips as described herein may be cast (e.g., by investment casting) as a single, integral part. In embodiments of such manufacturing methods, a molten casting liquid (e.g., a molten metal) can be introduced into a mold (e.g., an investment), whereupon the molten casting liquid can flow to fill the mold and take on the shape of the finished nozzle tip. Such shaped, molten casting liquid may then be cooled to form a nozzle tip having a liquid nozzle opening and center air outlet in fixed relation to one another, whereby proper registration of such features can be carefully controlled by design of the mold and exactly reproduced with each mold cycle. In the case of investment casting, the investment may then be removed from the nozzle tip to reveal the nozzle tip.

For example, the nozzle tips depicted in FIGS. 5-8 may be made according to the above-described casting methods. In particular, methods disclosed herein include introducing a molten casting liquid to a mold (not shown), forming, with the molten casting liquid in the mold, a spray axis 100, a nozzle body 53 comprising a nozzle outlet end 56 and a liquid nozzle opening 52 surrounding the spray axis. In one embodiment, further formed in the mold is a flange 60 attached to the nozzle body by a support member 66, the flange comprising a flange aperture 64 surrounding the spray axis and surrounding the nozzle outlet end such that a center air outlet 54 is defined between the flange aperture and the nozzle outlet end. The formed, molten casting liquid is then cooled to make a nozzle tip wherein the center air outlet and the liquid nozzle opening are fixed in relation to one another about the spray axis. As described above, nozzle tips as shown may be cast as integral, one piece nozzle tips. In some embodiments, the nozzle tip is cast such that the nozzle outlet end comprises a cylinder (see, e.g., cylindrical protrusion extending through the flange aperture 64 in FIG. 7, terminating in the leader line for reference number 56) and the flange aperture 64 is circular, such that the center air outlet is an annulus, the center air outlet and the liquid nozzle opening in the cooled nozzle tip being fixed in concentric relation to one another about the spray axis.

In other embodiments (some illustrative examples of which are described in more detail below), a nozzle tip for a liquid spray gun is described. The liquid spray gun includes a nozzle port and an air cap attached to the liquid spray gun over the nozzle port. The nozzle tip includes a liquid nozzle opening through which liquid exits during operation of the liquid spray gun and a center air outlet through which center air discharges when a liquid is sprayed through the nozzle tip. The nozzle tip is removably attached to the liquid spray gun over the nozzle port such that liquid passing through the nozzle port passes into the nozzle tip before exiting through the liquid nozzle opening of the nozzle tip. In addition, the nozzle tip can be disengaged from the liquid spray gun while the air cap remains attached to the liquid spray gun such that, as discussed herein, the nozzle tips can be changed without disturbing the remainder of the liquid spray gun. The nozzle tip may be removably attached to the liquid spray gun itself directly and/or to the air cap that is, itself, separately attached to the liquid spray gun. Because the nozzle tip defines the liquid nozzle opening and the center air outlet, the dimensions of both the liquid nozzle opening and the center air outlet are entirely fixed within the nozzle tip (as opposed to conventional spray head assemblies in which the air cap defines, at least in part, the dimensions of the center air outlet).

In other embodiments (some illustrative examples of which are described in more detail below), a liquid spray gun is described that includes a liquid spray gun body that includes a nozzle port; an air cap attached to the liquid spray gun body, wherein the air cap is positioned over the nozzle port; and a nozzle tip removably attached to the liquid spray gun over the nozzle port such that the nozzle tip is in fluid-tight communication with the nozzle port. The nozzle tip defines a liquid nozzle opening through which liquid exits during operation of the liquid spray gun and a center air outlet through which center air discharges when a liquid is sprayed through the nozzle tip. In addition, the nozzle tip can be disengaged from the liquid spray gun while the air cap remains attached to the liquid spray gun body such that, as discussed herein, the nozzle tips can be changed without disturbing the remainder of the liquid spray gun. The nozzle tips may be removably attached to the liquid spray gun body itself and/or to the air cap. Again, because the nozzle tip defines the liquid nozzle opening and the center air outlet, the dimensions of both the liquid nozzle opening and the center air outlet are entirely fixed within the nozzle tip (as opposed to conventional spray head assemblies in which the air cap defines, at least in part, the dimensions of the center air outlet).

In still other embodiments, the nozzle tips described herein may be provided in kits that include a plurality of the nozzle tips described herein. In some embodiments of the kits, at least two of the nozzle tips have liquid nozzle openings and/or center air outlets that have different dimensions.

One illustrative embodiment of a liquid spray gun as described herein is depicted in the exploded view of FIG. 1. The same liquid spray gun is depicted as assembled in FIG. 2. The liquid spray gun includes a variety of components including a liquid spray gun platform 10 and a spray head assembly 20 that is preferably releasably attached to the liquid spray gun platform 10 at a barrel interface 11. The spray head assembly 20 is preferably releasably attached to the platform 10 and provides features that control movement of both the liquid to be sprayed and the air used to atomize the liquid as described herein. In some embodiments, the spray head assembly 20 is disposable and can be thrown away after use (although in some instances it may be reused). If disposed after use, cleaning of the spray head assembly in some embodiments can be avoided and the spray gun can be conveniently changed over by, e.g., attaching a different spray head assembly connected to the same or a different liquid container.

Connection of the spray head assembly 20 to barrel interface 11 of the spray gun platform 10 may be achieved by any suitable technique. For example, connection structures on the spray head assembly 20 may cooperate (e.g., mechanically interlock) with the openings 11*a* and 11*b* at the barrel interface 11 to retain the spray head assembly 20 on the spray gun platform 10 as described herein. Many other connection techniques and/or structures may be used in place of those described herein, e.g., a bayonet type connection that facilitates rapid connection/disconnection of the spray head assembly with a simple push or push-twist action, clamps, threaded connections, etc.

The spray gun platform 10 may also include an optional handle 13*b* that fits over the stem portion 13*a* of the frame. The handle 13*b* may, in some embodiments, be custom designed according to the operator's preference, including custom fitting by means of a thermosetting resin. Custom-fitted handles may reduce operator fatigue by allowing for a grip surface that can be custom molded to fit the hand of an individual user. The handle 13*b* may, in some embodiments, be formed from a thermosetting resin and an intended user of the spray gun can grasp the handle while the resin is in an unhardened condition to impart a contoured surface to the handle that is customized for the hand of that user. In those embodiments in which the handle 13*b* is detachable from the stem portion 13*a* of the frame, similar handles can be readily prepared for other users of the spray gun which allows a single spray gun to be accompanied by an array of handles, each of which has a grip surface that has been custom-fitted to the hand of a different intended user.

The platform 10 may be constructed of any suitable material that can be molded, cast, etc. to form the features described herein. Examples of some potentially suitable materials may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others. If polymeric materials are used to construct the platforms, the polymeric material may include any suitable additives, fillers, etc., such as, e.g., glass fiber, glass or polymeric bubbles or microbubbles, electrically conductive and/or static dissipating materials such as, e.g., finely divided metals, metal salts, metal oxides, carbon or graphite, etc. Selection of the materials used in the platforms described herein may preferably be based at least in part on the compatibility of the selected materials with the materials to be sprayed (e.g., solvent resistance and other characteristics may need to be considered when selecting the materials used to construct the platforms).

Figure 2:
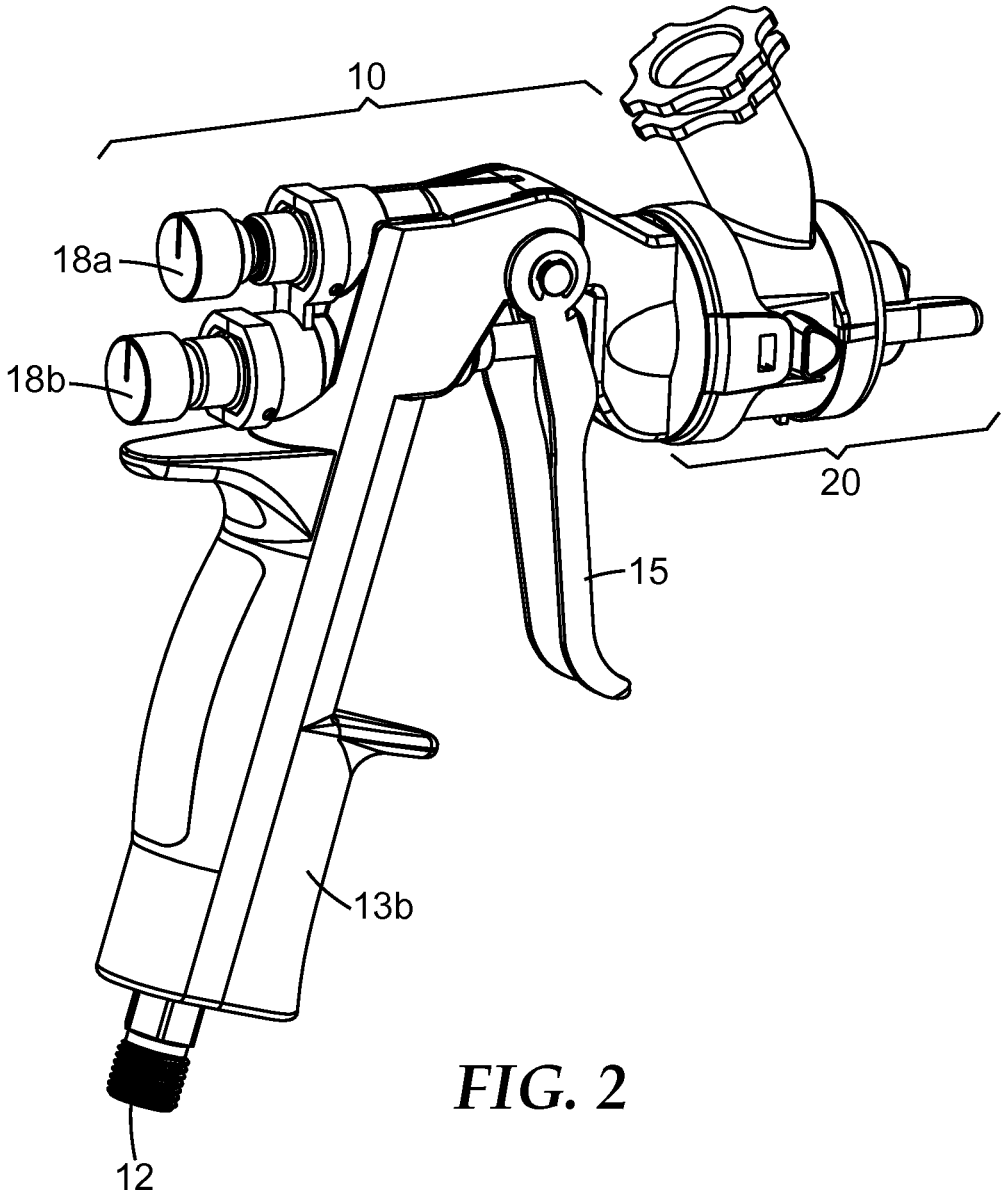
FIG. 2 is a perspective view of the liquid spray gun of FIG. 1 after assembly.

The spray gun platform 10 depicted FIGS. 1 and 2 may, in some embodiments, define a variety of cavities that, taken together, form the passages that deliver air to the spray head assembly 20. Among other features, the spray gun platform 10 includes a fitting 12 such that the air supply passages in the spray gun platform 10 can be connected to an air source (not shown) that supplies air to the spray gun platform 10 at greater than atmospheric pressure.

A needle passage is also provided in the spray gun platform 10 to allow a needle 14 to pass into a spray head assembly attached to the barrel interface. Referring to FIGS. 1 and 2, control over both air flow and liquid flow through the liquid spray gun is, in the depicted embodiment, provided by a trigger 15 that is pivotally engaged to the spray gun platform 10 by a retaining pin 16*a* and clip 16*b* (although any other suitable connection mechanism could be used). The needle 14 extends through the spray head assembly 20 in a manner similar to that described in, e.g., U.S. Pat. No. 7,032,839 (Blette et al.). The trigger 15 is preferably biased to the inoperative position in which needle 14 closes the liquid nozzle opening in the spray head assembly 20 and also closes an air supply valve 17. The biasing force may be provided by a coil spring (positioned between air supply valve 17 as part of the center air control assembly 18*b*), although other biasing mechanisms may be used and those biasing mechanisms may be located in other positions (e.g., between the trigger 15 and the handle 13*b*).

When the trigger 15 is depressed, needle 14 is retracted to a position in which tapered front end 14*a* allows liquid to flow through liquid nozzle opening in the spray head assembly 20. At the same time, air supply valve 17 also opens to deliver air to the spray head assembly 20 from the passages in the spray gun platform 10. Air and liquid flow may be further controlled by a fan air control assembly 18*a* which controls air delivered to a fan air passage outlet 19*a* from the air supply manifold in the platform 10 and center air control assembly 18*b* which controls air delivered to a center air passage outlet 19*b* from the air supply manifold in the platform 10. In particular, the control assembly 18*b* controls the center air/liquid stream emanating from the spray head assembly 20, and control assembly 18*a* controls air flow to the air horns (if provided) of the spray head assembly 20 to adjust the spray pattern geometry. In some embodiments, however, it should be understood that adjustment of the center air control assembly 18*b* may affect air flow through the fan air control assembly 18*a* (or vice versa).

Further details regarding various embodiments of spray gun platforms that may be used in connection with the nozzle tips and spray head assemblies described herein to provide a complete liquid spray gun may be described in US Patent Application Publications US 2010/0187333 (Escoto, Jr. et al.); US 2004/0140373 (Joseph et al.); US 2006/0065761 (Joseph et al.) and US 2006/0102550 (Joseph et al.); as well as U.S. Pat. No. 6,971,590 (Blette et al.); U.S. Pat. No. 6,820,824 (Joseph et al.); U.S. Pat. No. 6,971,590 (Blette et al.); U.S. Pat. No. 7,032,839 (Blette et al.); U.S. Pat. No. 7,201,336 (Blette et al.); and U.S. Pat. No. 7,484,676 (Blette et al.).

Some illustrative embodiments of the nozzle tips and/or spray head assemblies that may be used with the spray gun platforms to provide complete liquid spray guns are described herein. Although the illustrative embodiments of nozzle tips and spray head assemblies described herein may be advantageously used with spray gun platforms, the described embodiments are illustrative only and other nozzle tips and/or spray head assemblies may be substituted for those described herein to provide a complete liquid spray gun.

As seen in FIGS. 1 and 3-5, some embodiments of the spray head assemblies described herein may be provided in the form of a combination of three different components that are connected to each other to form a completed spray head assembly 20. More specifically, the spray head assembly 20 may include a barrel 30, an air cap 40, and a nozzle tip 50. The barrel 30, air cap 40, and nozzle tip 50 of the spray head assembly 20 preferably combine to form cavities and passageways that deliver the center air and the fan control air in a substantially separated manner through the spray head assembly.

Figure 3:
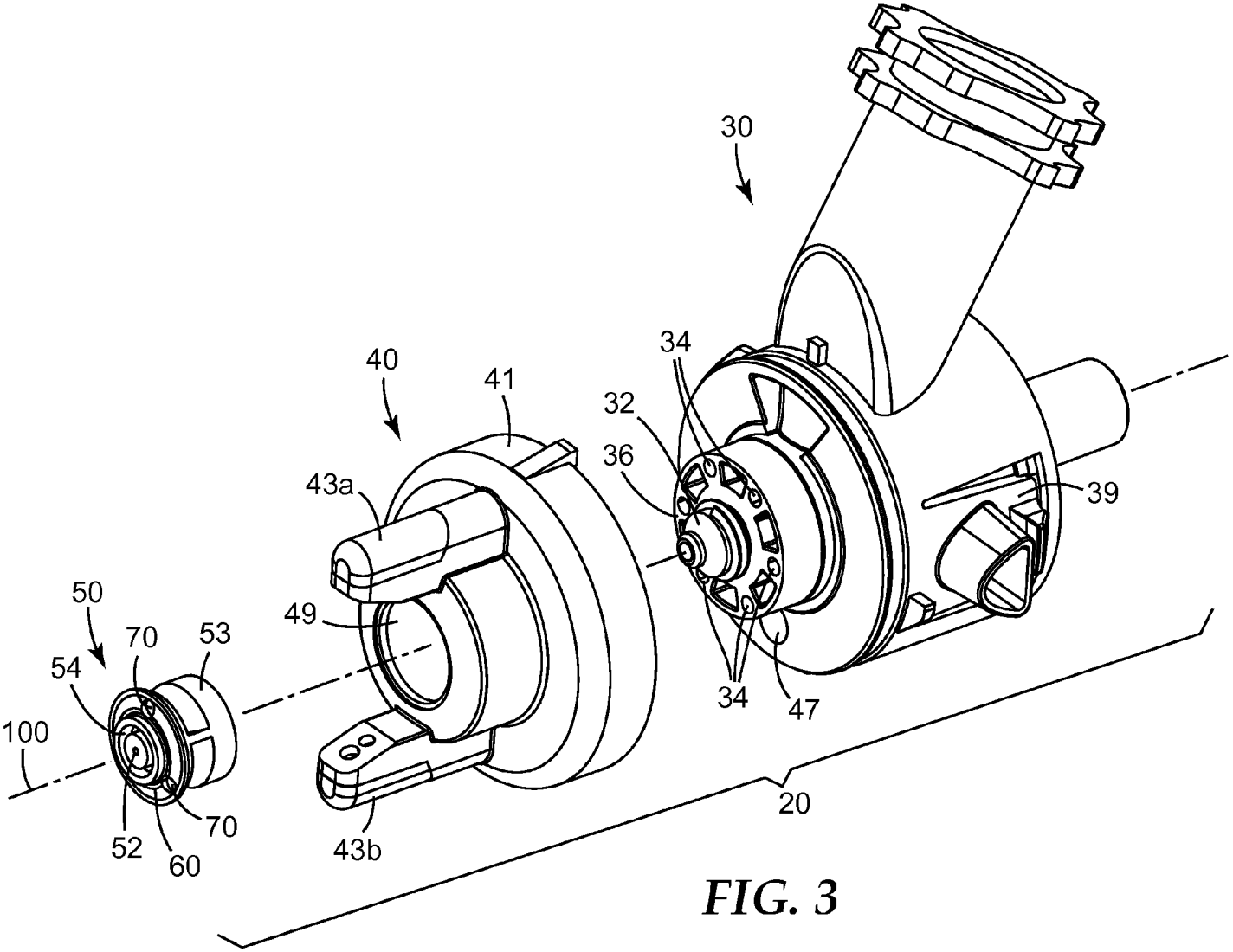
FIG. 3 is an exploded perspective view of one illustrative embodiment of a spray head assembly as described herein.
Figure 4:
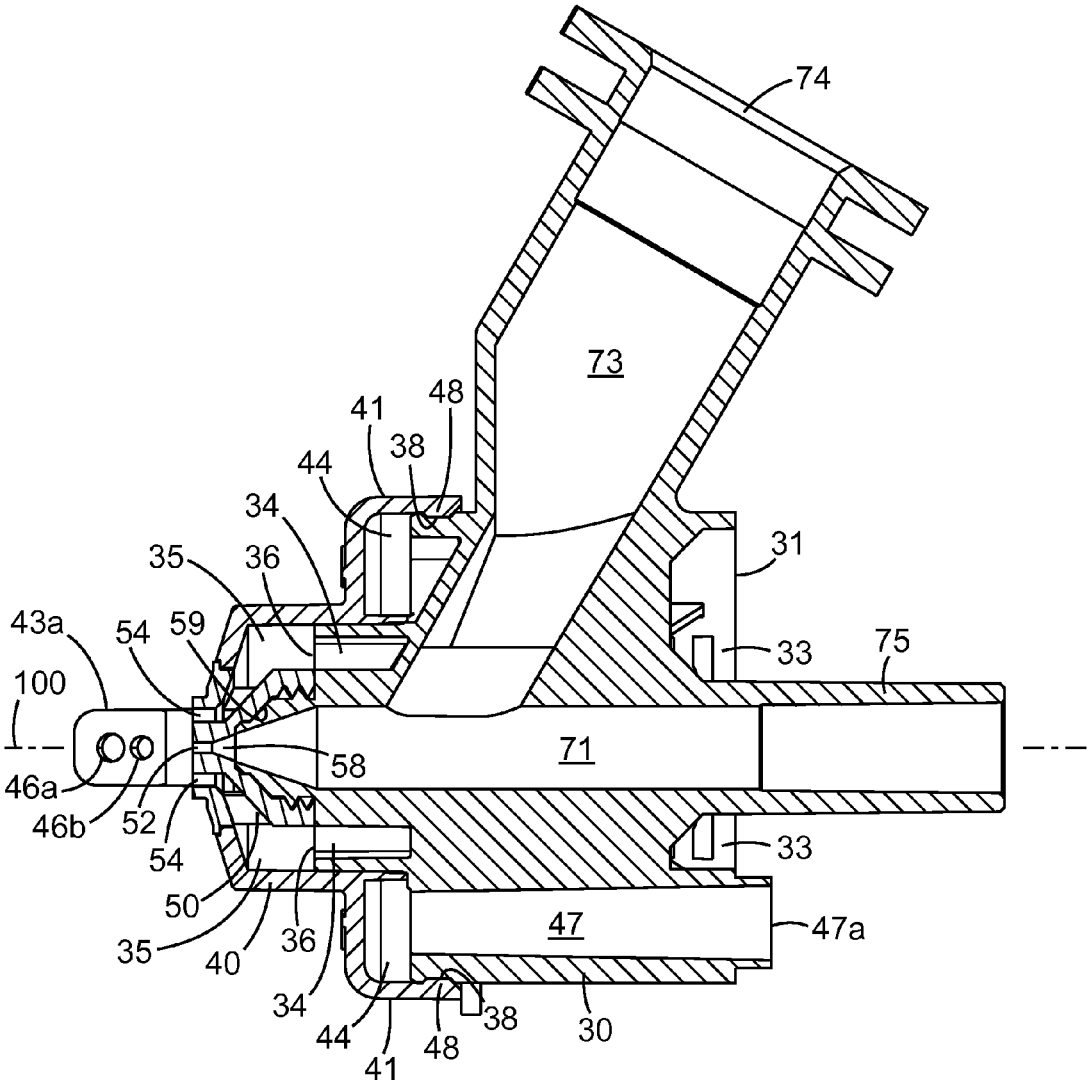
FIG. 4 is a vertical cross-sectional view of the spray head assembly of FIG. 3 as assembled.

Referring to FIGS. 3-5, the barrel 30 may preferably include many of the same features described in connection with the barrels described in US Patent Publication US 2010/0187333 (Escoto Jr. et al.) and U.S. Pat. No. 6,971,590 (Blette et al.) including a barrel inlet 31 that preferably seals with the barrel interface 11 on a spray gun platform to which the barrel 30 is attached.

One difference between the spray head assemblies described herein and the spray head assemblies described in US Patent Publication US 2010/0187333 (Escoto Jr. et al.) and U.S. Pat. No. 6,971,590 (Blette et al.) is, however, that the barrel 30 does not, itself, form the liquid nozzle opening through which liquid being sprayed exits. Rather, the nozzle tip 50 is attached to a liquid nozzle port 32 on the barrel 30, with the nozzle tip 50 including the liquid nozzle opening 52 through which liquid being sprayed exits from the spray head assembly 20.

The barrel 30, as a result, includes features that define a liquid passageway 71 that terminates in the liquid nozzle port 32 through which the liquid to be sprayed exits the barrel 30 and enters the nozzle passage 58 of nozzle tip 50 (see, e.g., FIG. 7). Liquid enters the liquid passageway in the barrel 30 from a liquid inlet passage 73 that is fed through liquid port 74. The liquid passageway 71 defined in the barrel 30 may preferably be isolated from the other features in the barrel 30. The liquid passageway 71 may preferably be sized to receive a needle 14 (see, e.g. FIG. 1) that is capable of closing the liquid nozzle opening 52 when advanced in the forward direction (to the left in the views depicted in FIGS. 1, 3 and 4) and opening the liquid nozzle opening 52 when retracted in the rearward direction (to the right in FIGS. 1, 3, and 4). The liquid passageway 71 may further include a needle housing extension 75 that extends rearward of the barrel 30 and may preferably fit within a needle passage in the liquid spray gun platform 10.

The barrel wall of the barrel 30 defines a barrel cavity 33 that surrounds the liquid passageway 71. The barrel cavity 33 receives air flowing out of the center air passage outlet 19*b* (see, e.g., FIG. 1) in the barrel interface 11 of the spray gun platform 10. As a result, the barrel cavity 33 defines a portion of a center air chamber within the spray head assembly 20. The center air entering the barrel cavity 33 passes through the barrel 30 and exits the barrel cavity 33 through one or more openings 34 provided in the barrel 30.

The openings 34 in the barrel 30 deliver the center air exiting the barrel cavity 33 to a nozzle cavity 35 formed between the air cap 40 and the front wall 36 of the barrel 30. Air entering the nozzle cavity 35 flows through the nozzle cavity 35 until it exits the nozzle cavity 35 though a center air outlet 54 formed in the nozzle tip 50. Together, the barrel cavity 33 and the nozzle cavity 35 combine to form a portion of what can be characterized as the center air chamber of the spray head assembly 20. As described herein, the center air chamber essentially extends from the barrel inlet 31 to the center air outlet 54 of the spray head assembly 20. The center air outlet 54 may, in some embodiments, preferably surround the liquid nozzle opening 52 such that the center air passing through the center air outlet 54 can atomize and form the liquid passing through the liquid nozzle opening 52 into a generally conical stream.

The nozzle tip 50, as discussed above, preferably provides both the liquid nozzle opening 52 and the center air outlet 54 of the spray head assembly 20. The nozzle tip is removably attached to the barrel 30 over the liquid nozzle port 32. In the depicted embodiment, the nozzle tip 50 may be attached to the liquid nozzle port by a threaded attachment as shown where the nozzle port 32 forms the male part while the nozzle tip 50 forms the female part of the connection, while in other embodiments that arrangement may be reversed.

Although a threaded attachment between the nozzle port 32 and the nozzle tip 50 may be used in some embodiments, any suitable attachment mechanism may be used to removably attach the nozzle tip 50 to the nozzle port 32. Other potential connection mechanisms may include, e.g., a bayonet-type mount, a Luer lock connection, a snap fit assembly, etc. It may be preferred, but is not required that attachment and removal be accomplished by rotating the nozzle tip 50 relative to the barrel port 32 around a spray axis 100 that extends through the liquid nozzle opening 52.

As described herein, a removable nozzle tip is a nozzle tip that can be removed from the nozzle port 32 without damaging the nozzle port 32 such that a different nozzle tip could be attached to the nozzle port 32 and function properly. In some embodiments, the nozzle tip 50 itself may be damaged by removal from the nozzle port 32 such that it cannot be reliably re-used, while in other embodiments, the nozzle tip 50 may not be damaged by removal from the nozzle port 32 such that it can be reliably re-used on the same or a different spray head assembly.

The air cap 40 that is provided as a part of the illustrative embodiment of spray head assembly 20 is depicted in FIGS. 1-5. The air cap 40 is preferably attached to the barrel 30 in a manner that allows for rotation of the air cap 40 about the axis 100 relative to the barrel 30. Rotation of the air cap 40 may be used to change the orientation of the pattern of the atomized spray emitted from the spray head assembly 20 relative to the axis 100.

In the depicted embodiment, the air cap 40 is retained in place over the front wall 36 of the barrel 30 by an interlocking arrangement of the annular recess 38 on the barrel 30 (see, e.g., FIGS. 3-5) and a complementary raised annular ridge 48 on the interior surface of the air cap 40 (see, e.g., FIG. 4). The junction between the air cap 40 and the barrel 30 may preferably have a limited clearance such that leakage of fan control air through that junction is limited and/or to generate some friction to provide a resistive force to rotation of the air cap 40 about the axis 100 (although preferably not so much force as to prevent rotation of the air cap 40 without tools). In some embodiments, a gasket, o-ring, or other seal element may be provided at the junction between the air cap 40 and the barrel 30 to provide additional control over leakage and/or rotational resistance.

As discussed herein, the air cap 40 defines a nozzle cavity 35 at the front wall 36 of the barrel 30. In addition, the air cap 40 may also define optional cavities that, taken together, make up a portion of an optional fan control air chamber in the spray head assembly 20. Specifically, the ring portion 41 of the air cap 40 defines a ring cavity 44 located between the ring portion 41 of the air cap 40 and the barrel 30.

The air cap 40 also includes an optional pair of air horns 43*a* and 43*b*, each of which defines a horn cavity 45*a* and 45*b* (respectively) into which fan air enters from the ring cavity 44. Fan air delivered into the air horn cavities 45*a* and 45*b* exits the cavities through apertures 46*a* and 46*b* on the air horns 43*a* and 43*b*. The apertures 46*a* and 46*b* on the horns 43*a* and 43*b* are located on opposite sides of the axis 100 such that air flowing through the fan air chamber under greater than atmospheric pressure flows against opposite sides of a stream of atomized liquid formed by air flowing through the center air chamber. The forces exerted by the fan air can be used to change the shape of the stream of liquid to form a desired spray pattern (e.g., circular, elliptical, etc.). The size, shape, orientation, and other features of the apertures may be adjusted to achieve different fan control characteristics as described in, e.g., U.S. Pat. No. 7,201,336 B2 (Blette). In the depicted embodiment, the apertures 46*a* and 46*b* are in the form of circular bores.

Fan air is delivered into the fan air chamber in the spray head assembly 20 from the spray gun platform 10 through fan air passage outlet 19*a* in the barrel interface 11 (see, e.g., FIG. 1). Isolation of the fan air from the center air may be maintained since the fan air passes through the barrel 30 by directing the fan air through a fan air barrel passage 47 formed in the barrel 30 (see, e.g., FIG. 4). Air enters the fan air barrel passage 47 through an inlet end 47*a* from the fan air passage outlet 19*a* of the platform 10 and is delivered to the ring cavity 44 for distribution to the air horn cavities 45*a* and 45*b*. Taken together, the fan air barrel passage 47, the ring cavity 44, and the air horn cavities 45*a* and 45*b* make up the fan air chamber of the spray head assembly 20.

The barrels used in spray head assemblies as described herein may also include structure to assist with connection and retention of the spray head assembly on a spray gun platform. In the embodiment of the barrel 30 as depicted in FIGS. 1-3, the connection structure may take the form of a pair of connection tabs 39 (although in some embodiments a single connection tab and associated lever element may potentially be used to make the connection). Alternatively, the barrel 30 could be attached to the spray gun platform 10 by any other suitable connection structure, e.g., a threaded connection, clamps, bayonet connections, etc.

As discussed herein, the nozzle tips used in connection with the spray head assemblies and spray guns described herein are preferably removable such that the nozzle tip can be removed and replaced without requiring removal of the air cap and/or the barrel of a spray gun. One illustrative embodiment of a nozzle tip 50 is depicted in connection with FIGS. 1-5 and that nozzle tip 50 is further depicted in enlarged views in FIGS. 6-8.

As described herein, the nozzle tip 50 includes a nozzle body 53 and a flange 60 attached to the nozzle body 53. The nozzle body 53 has an inlet end 55 and a nozzle outlet end 56. The liquid nozzle opening 52 is formed in the nozzle outlet end 56 of the nozzle body 53. The flange 60 is attached to the nozzle body 53 proximate the nozzle outlet end 56. The center air outlet 54 of the spray head assembly 20 is defined between the flange 60 and the nozzle outlet end 56 of the nozzle body 53. The nozzle body 53 also defines a nozzle passage 58 (see, e.g., FIGS. 4 and 5) that extends between a nozzle passage inlet 57 and the liquid nozzle opening 52 of the nozzle tip 50. As a result, the nozzle passage 58 can be described as extending through the nozzle body 53 from the nozzle passage inlet 57 to the liquid nozzle opening 52, such that liquid entering the nozzle passage 58 through the nozzle passage inlet 57 leaves the nozzle tip 50 through the liquid nozzle opening 52 after passing through the nozzle passage 58. The depicted nozzle passage 58 is tapered such that the cross-sectional area of the nozzle passage 58 decreases when moving through the nozzle passage 58 from the inlet end 55 towards the liquid nozzle opening 52. The nozzle passages in other nozzle tips may alternatively have a constant cross-sectional area, or may take any other selected shape.

As described herein, the nozzle tip 50 is attached to a nozzle port 32 on the barrel 30 and may include a nozzle sealing surface 59 such that the nozzle body 53 forms a liquid tight seal with the nozzle port 32 when the nozzle tip 50 is attached to the barrel 30 such that liquid exiting the nozzle port 32 enters the nozzle passage 58 in the nozzle tip 50 without leaking into the center air chamber under normal operating conditions. The sealing surface 59 may, in some embodiments, include a gasket, or-ring or other sealing element to assist in formation of the seal.

The flange 60 of the nozzle tip 50 includes an internal surface 61 that faces the inlet end 55 of the nozzle body 53 and an external surface 62 that faces away from the inlet end 55 of the nozzle body 53. The space or volume formed between the internal surface 61 of the flange 60 and the nozzle body 53 can be described as a nozzle tip portion of the center air chamber (which also includes the barrel cavity 33 and the nozzle cavity 35 as described herein). In other words, the center air chamber as formed in the spray head assembly 20 includes all connected volumes upstream of the center air opening 54, i.e., the volume of the nozzle tip portion (located between the internal surface 61 of the flange 60 and the nozzle body 53), the remainder of the volume of the nozzle cavity 35, and the volume of the barrel cavity 33.

The flange 60 further includes a flange aperture 64 that extends through the internal and external surfaces 61 and 62 of the flange 60. The flange aperture 64 is larger than the nozzle outlet end 56 of the nozzle body 53 and the nozzle outlet end 56 of the nozzle body 53 is located in the flange aperture 64 such that a gap is found between the flange aperture 64 and the nozzle outlet end 56 of the nozzle body 53. That gap between the flange aperture 64 and the nozzle outlet end 56 forms the center air outlet 54 in the nozzle tip 50. Air entering the nozzle tip portion of the center air chamber passes through the center air outlet 54 around the nozzle outlet end 56 of the nozzle body 53. Because of the arrangement of the flange 60 and the nozzle body 53, the nozzle passage 58 in the nozzle body 53 and the nozzle tip portion of the center air chamber are independent of each other such that liquid exiting the nozzle passage through the liquid nozzle opening 52 and air exiting the center air chamber through the center air outlet are separated from each other until they exit their respective orifices.

The flange 60 may be attached to the nozzle body 53 by any suitable structure. In the illustrative embodiment depicted in FIGS. 6-8, the flange 60 is attached to the nozzle body 53 by support members 66 that extend between the nozzle body 53 and the flange 60. In the depicted embodiment, the nozzle tip 50 includes three support members 66, although as few as one or two support members or more than three support members may be used to attach the flange 60 to the nozzle body 53. The support member or members may take any suitable form so long as they connect the flange to the nozzle body and allow center air to flow through the center air outlet 54.

When the nozzle tip 50 is attached to the barrel 30, the flange 60 of the nozzle tip 50 preferably closes a nozzle tip opening 49 in the air cap 40 such that air leaving the center air chamber is directed through that center air outlet 54 in the nozzle tip 50. Air in the center air chamber may, in some embodiments, be restricted from exiting the center air chamber through an interface between the nozzle tip opening 49 in the air cap 40 and the flange 60 by a seal provided at that interface. In some embodiments, the outer edge 68 of the flange 60 preferably forms a seal with the inner edge of the nozzle tip opening 49. In the illustrative embodiment depicted in, e.g., FIGS. 4-8, the outer edge 68 of the flange 60 mates with the inner edge of the nozzle tip opening 49 to form a tortuous path that may assist in restricting the flow of air through the flange-nozzle tip opening interface.

Regardless of the form of any seal between the nozzle tip 50 and the air cap 40, the seal should allow for removal of the nozzle tip 50 from the barrel 30 while the air cap remains attached to the barrel 30. As a result, the nozzle tip 50 can be removed for cleaning and/or replacement without requiring removal or detachment of any other component of the spray head assembly.

It should be understood that the seal formed between the flange 60 and the air cap 40 need not be an air-tight seal. Rather, the seal formed should be sufficiently restrictive so that air entering the center air chamber from the air source attached to the liquid spray gun is preferentially directed through the center air outlet 54. In other words, some leakage through the seal between the air cap 40 and the flange 60 may be tolerated as long as it does not prevent acceptable atomization of the liquid being delivered through the liquid nozzle opening in the nozzle tip.

Another optional feature depicted in connection with the illustrative embodiment of the nozzle tip 50 of FIGS. 6-8 are the interlocking engagement features 70 that, in the depicted embodiment, are located on the external surface 61 of the flange 60. The interlocking engagement features 70 are provided in the form of depressions that may be engaged by a tool or other object (e.g., fingers, etc.) such that the nozzle tip 50 can be rotated about a spray axis 100 (see, e.g., FIG. 3) to assist in attachment or removal of the nozzle tip where rotation is a part of any such process. Although the interlocking engagement features 70 may, in the depicted embodiment, be in the form of depressions, the interlocking engagement features may take any other form that provides for engagement such that the nozzle tip 50 can be rotated, e.g., posts, etc.

Figure 9:
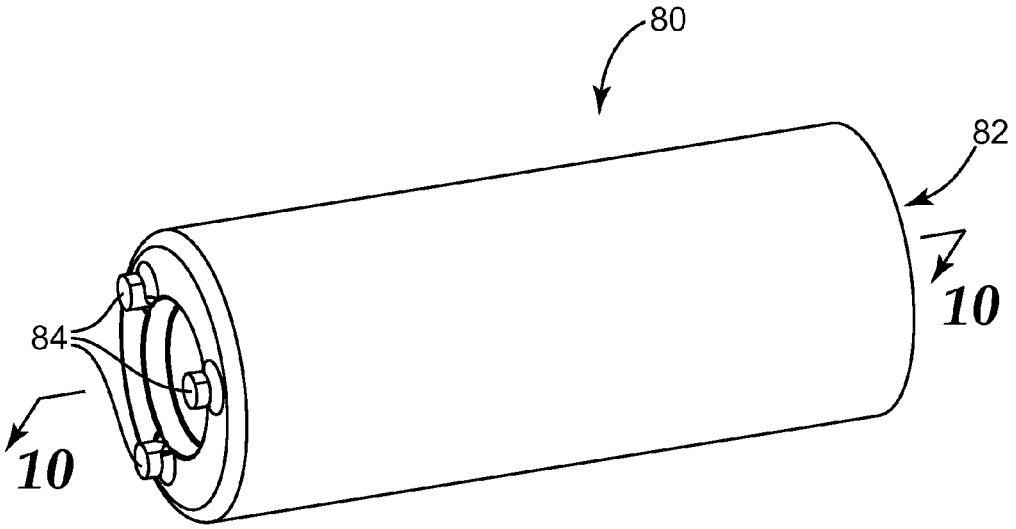
FIG. 9 is a perspective view of one illustrative embodiment of a tool that can be used to attach and detach nozzle tips as described herein.
Figure 10:
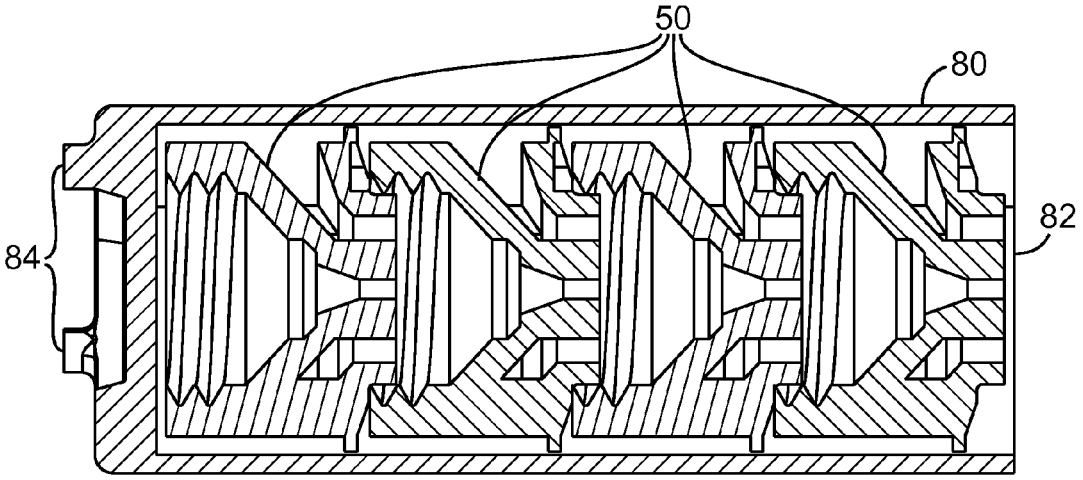
FIG. 10 is a cross-sectional view of the tool of FIG. 9 taken along line 10-10 on FIG. 9 depicting a set of optional nozzle tips located therein.

One illustrative embodiment of a tool 80 that may be used to attach and detach nozzle tips as described herein is depicted in FIGS. 9-10. The tool 80 includes complementary features 84 that are preferably shaped and configured to interact with the engagement features 70 on the nozzle tip 50 as described herein. The tool 80 may preferably be hollow and, if so, may preferably be capable of containing one or more additional nozzle tips 50 that can be dispensed from an opening 82 in the tool 80 and used as needed.

The nozzle tips (and other components described herein) may be manufactured of any suitable material or combination of materials and by any manufacturing technique or techniques suitable for the selected material or materials, e.g., molding, casting, machining, direct digital manufacturing, etc.). In some embodiments, the nozzle body 53 and the flange 60 (and any connecting structure) may be molded or otherwise formed as an integral, one-piece component which requires no assembly to provide a completed nozzle tip, while in other embodiments, the nozzle tips 50 may be formed as a multi-piece assembly (e.g., two, three, or more pieces) that can be assembled to form a nozzle tip that includes the features of nozzle tips as described herein. Some examples of potentially suitable materials that can be used to manufacture the nozzle tips may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others. If polymeric materials are used to construct the nozzle tips, the polymeric materials may include any suitable additives, fillers, etc., such as, e.g., glass fiber, glass or polymeric bubbles or microbubbles, electrically conductive and/or static dissipating materials such as, e.g., finely divided metals, metal salts, metal oxides, carbon or graphite, etc. Selection of the materials used in the nozzle tips described herein may preferably be based at least in part on the compatibility of the selected materials with the materials to be sprayed (e.g., solvent resistance and other characteristics may need to be considered when selecting the materials used to construct the nozzle tips).

Although the nozzle tips may be provided alone and the spray head assemblies described herein may be provided with a nozzle tip, air cap and barrel that are either pre-assembled or that can be assembled to for a spray head assembly, in some instances two or more nozzle tips may be provided as a part of kit that may be supplied to a party that already has the other components of a spray head assembly (e.g., a barrel and/or air cap) or the kit may include one or more barrels and/or one or more air caps and two or more nozzle tips.

As discussed herein, the nozzle tips 50 can be removed from the spray head assembly 20 without requiring that the air cap 40 and/or the barrel 30 be removed from the spray gun. The nozzle tips described herein may be removed for cleaning and/or replacement. If multiple nozzle tips are provided in a kit, the different nozzle tips may or may not include different features. In various embodiments of the kits, for example, at least two of the nozzle tips may have center air outlets having different dimensions (e.g., different diameters, different cross-sectional areas, at least two of the nozzle tips may have liquid nozzle openings having different dimensions (e.g., different diameters, different cross-sectional areas, etc.), at least two nozzle tips of the plurality of nozzle tips may have liquid nozzle openings having different dimensions and center air outlets having different dimensions. In some embodiments, each nozzle tip of the plurality of nozzle tips may have a threaded connection at the inlet end of the nozzle body to facilitate attachment to a spray head assembly. In some embodiments, color-coding may be used to identify nozzle tips having different characteristics.

Figure 11:
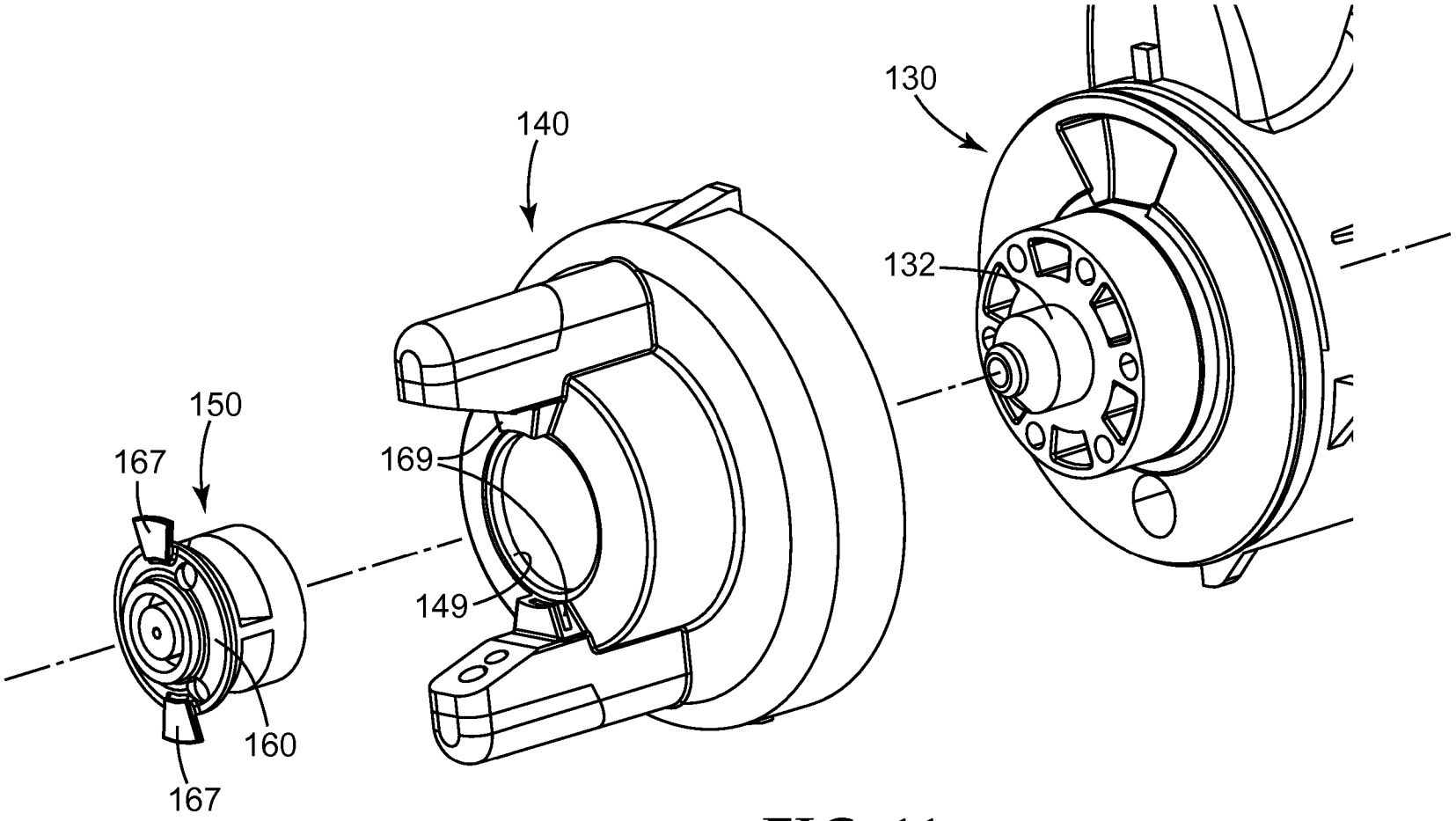
FIG. 11 is an exploded perspective view of a portion of another illustrative embodiment of a spray head assembly as described herein.

FIG. 11 depicts a portion of another illustrative embodiment of a spray head assembly in which the nozzle tip 150 is attached to the air cap 140 such that the nozzle tip 150 is functionally connected to the nozzle port 132 (which, in the depicted embodiment, is on the barrel 130—where only a portion of the barrel 130 is depicted in FIG. 11) such that liquid exiting the nozzle port 132 enters the nozzle tip 150, but in which the nozzle tip 150 is not physically connected to the nozzle port 132 by, e.g., threads as depicted in the illustrative embodiments described above.

The connection between the nozzle tip 150 and the air cap 140 may, in the depicted embodiment, be accomplished by a one or more tabs 167 extending from the flange 160 of the nozzle tip 150. The tabs 167 are preferably designed to cooperate with slots 169 positioned about the nozzle tip opening 149 in the air cap 140 such that rotation of the nozzle tip 150 about a spray axis locks the tabs 167 in the slots 169 such that the nozzle tip 150 is attached to the air cap 140. Furthermore, the nozzle tip 150 preferably makes the required connection with nozzle port 132 as discussed herein.

It should be understood that the tabs 167 and slots 169 represent only one of many different cooperating structures that could be used to attach the nozzle tip 150 to the air cap 140. Some potentially suitable alternatives may include, but are not limited to, e.g., a threaded connection, a snap fit connection, etc.

Figure 12:
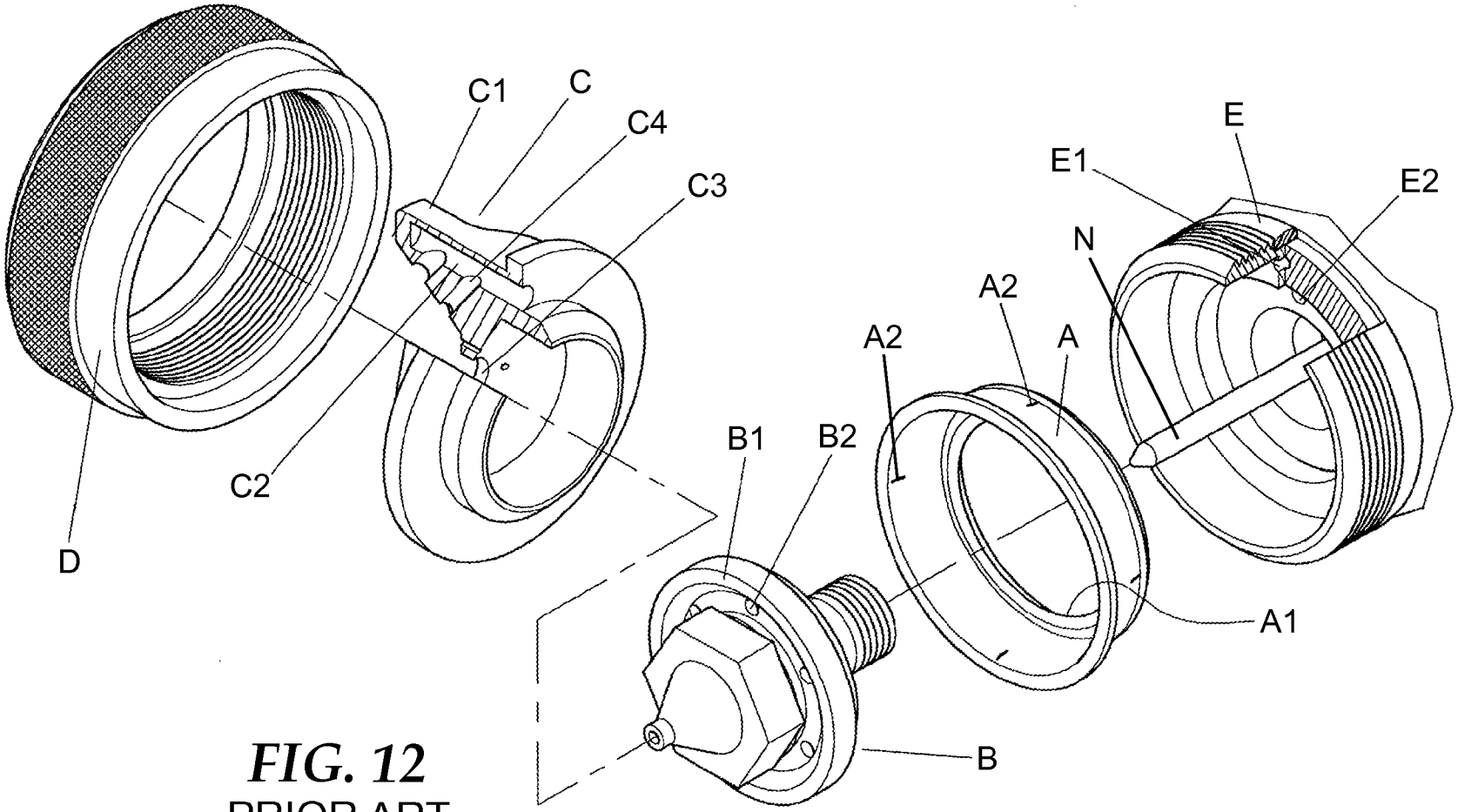
FIG. 12 PRIOR ART
FIG. 12 is an exploded view of a portion of one embodiment of a prior art spray head assembly in which selected portions have been removed to illustrate certain features more clearly.
Figure 13:
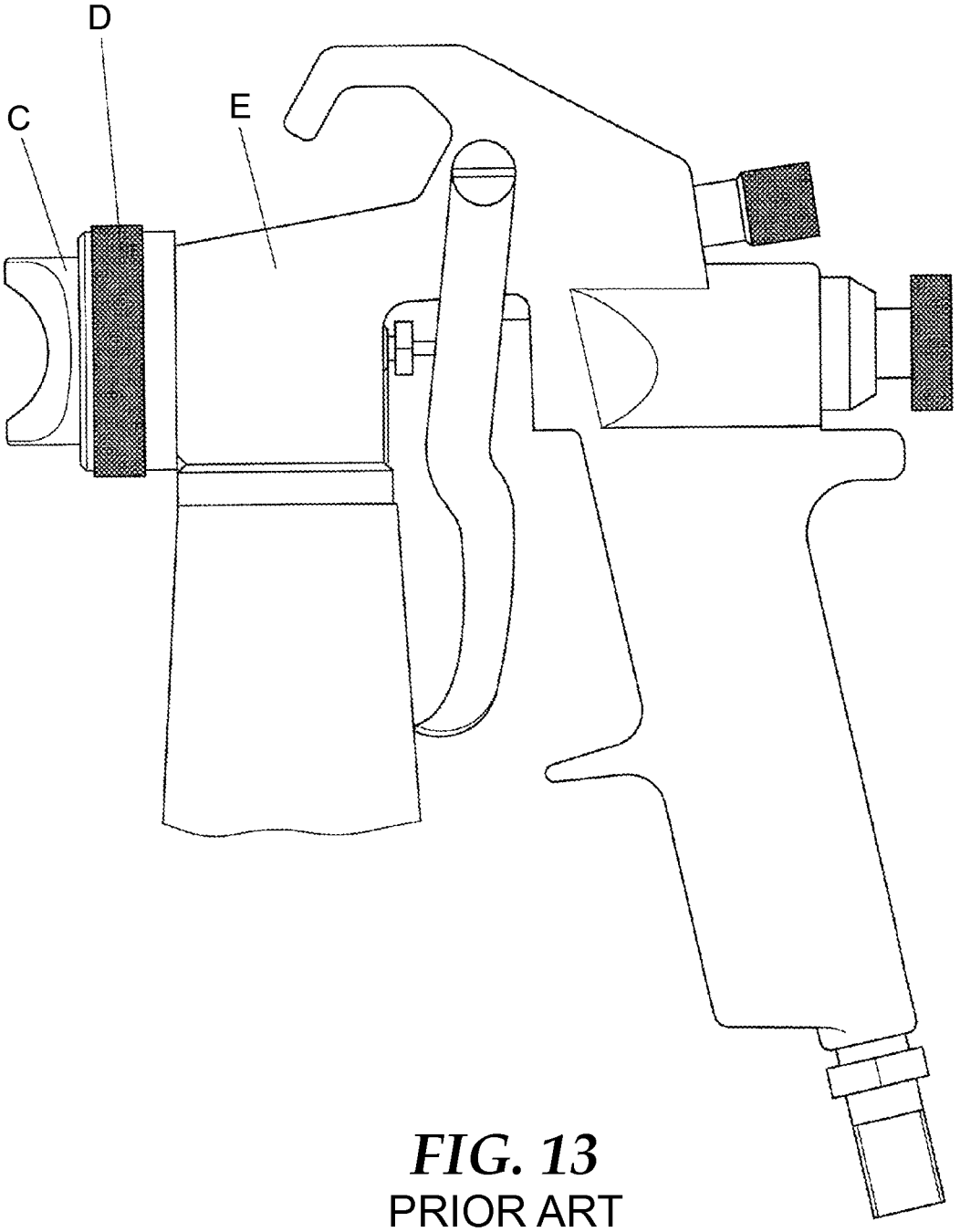
FIG. 13 PRIOR ART
FIG. 13 is a side view of a prior art spray gun with the spray head assembly of FIG. 12 mounted thereon.
Figure 14:
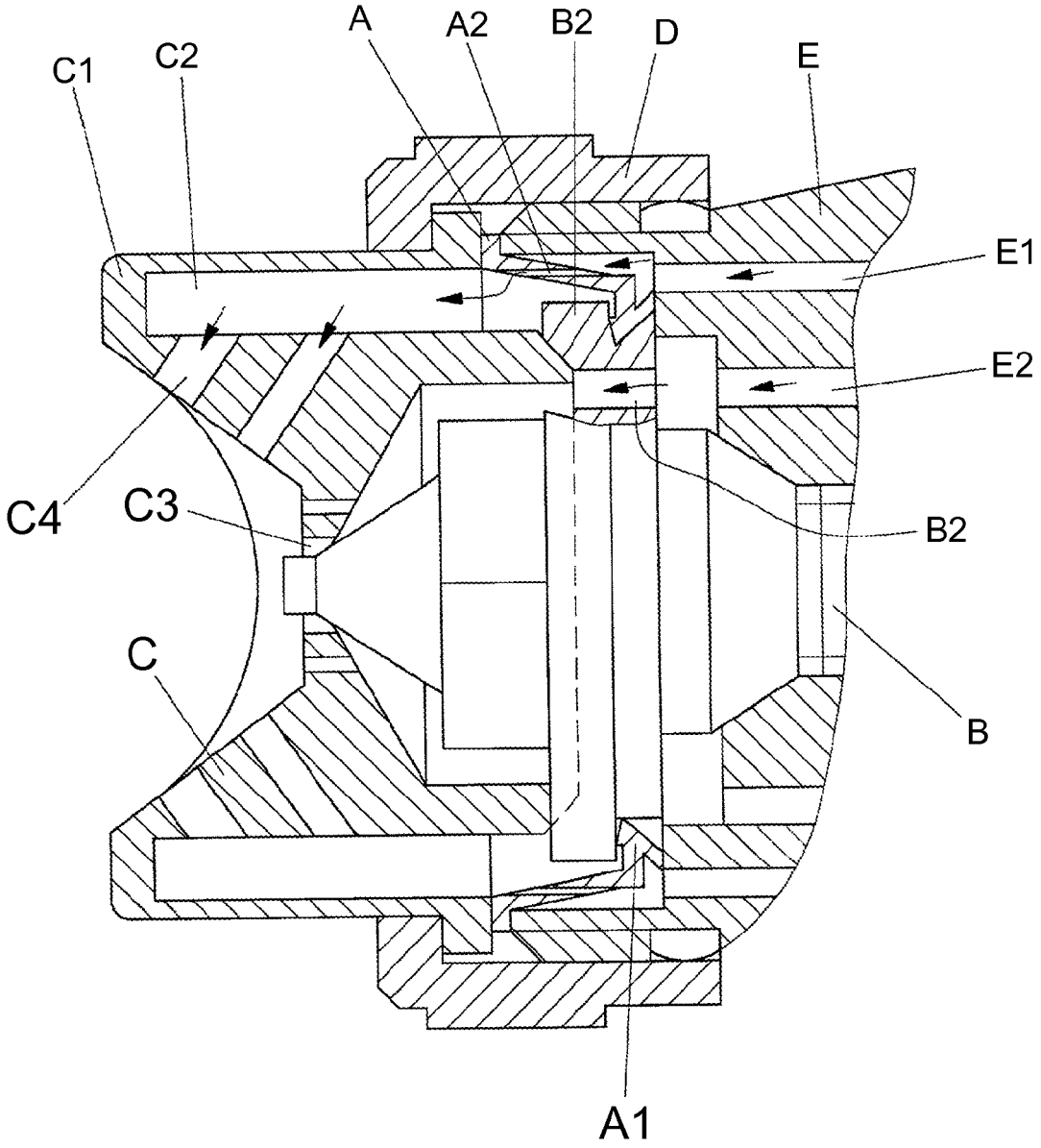
FIG. 14 PRIOR ART
FIG. 14 is an enlarged vertical cross-sectional view of a portion the spray head assembly as depicted in FIG. 13.

Another illustrative alternative embodiment of a spray head assembly that includes a removable nozzle tip as described herein is depicted in connection with FIGS. 12-16. In particular, FIGS. 12-14 depict a conventional liquid spray gun that includes a ring A, a nozzle B, a needle N, an air cap C, and a retaining ring D. The nozzle B is located at the center of the front end of the spray gun. The spray gun E includes openings E1 and E2 that supply center air and fan air. The nozzle B includes a circular rim B1 having air holes B2 formed therein. The ring A is in a bowl shape having a rim A1 at the narrow side with openings A2. The air cap C includes a pair of air horns C1 that include air passages C2 and openings C4. The air cap C also includes a nozzle opening C3 at its center portion, and a pair of air holes C4 at respective sides.

Assembly of the spray gun with the spray head assembly involves attaching the nozzle B to the spray gun platform E using the threaded connector which threads into a complementary bore in the gun platform E. The circular rim B1 of the nozzle B holds the ring A in place on the spray gun platform E. With the nozzle B in place, the air cap is placed over the nozzle and held in place using the retaining ring D, which threads onto the spray gun platform E using the depicted threads. The needle N is then located within the nozzle B to control the flow of liquid through the nozzle B.

During operation, pressurized air passes through the openings E1 and E2 of the spray gun E as depicted by the arrows in FIG. 14. The air passing from opening E1 provides the fan air as it passes through openings A2 in the ring A, where it then passes into the air passages C2 in the air horns C1 for delivery through the openings C4 as depicted by some of the arrows in FIG. 14. The air passing from the opening E2 passes through openings B2 in the circular rim B1 of nozzle B and then proceeds around nozzle B until it exits through C3 around the nozzle B. In essence, the circular rim B1 of the nozzle B and the ring A define a barrel cavity in the spray gun E. Movement of the needle N within the nozzle B controls the flow of liquid through the nozzle B.

Because the nozzle B is held in place behind the air cap C and the nozzle opening C3 in the air cap C is used to form the center air outlet around the nozzle B, removal of the nozzle B for cleaning and/or replacement requires removal of the air cap C.

Figure 15:
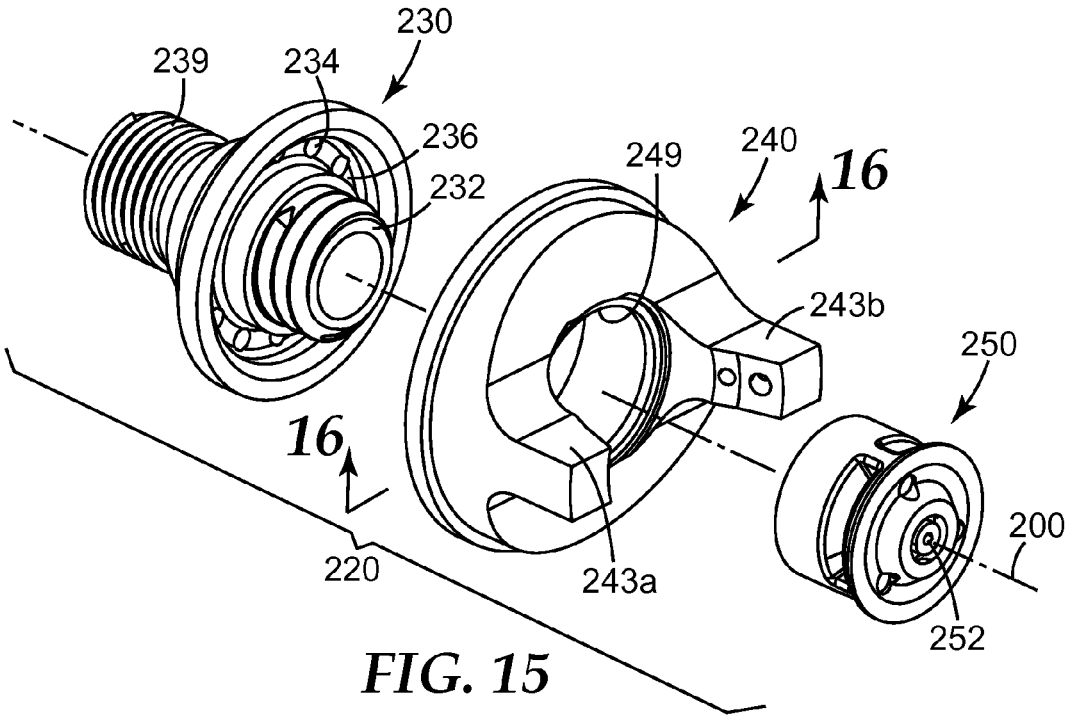
FIG. 15 is an exploded perspective view of another illustrative embodiment of a spray head assembly as described herein.
Figure 16:
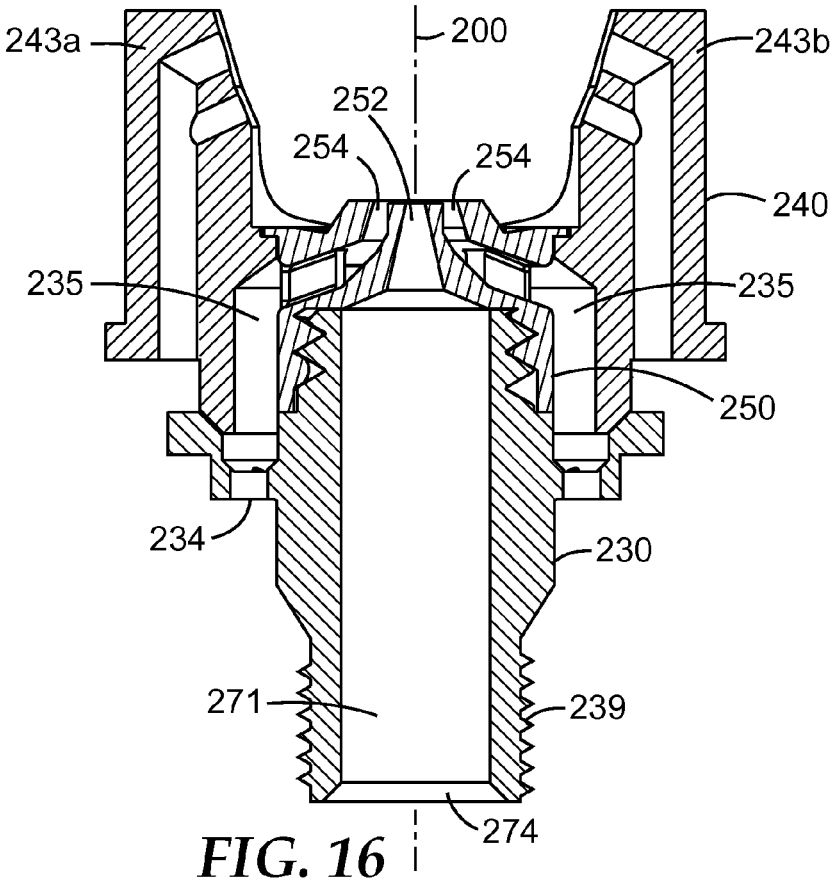
FIG. 16 is a cross-sectional view of the components of the spray head assembly of FIG. 15 as assembled, with the cross-sectional view taken along line 16-16 in FIG. 15.

The spray head assembly components depicted in FIGS. 15-16 can be used to retrofit a conventional spray gun such as that depicted in FIGS. 12-14 and similar guns. In particular, the spray head assembly kit depicted in FIGS. 15-16 include a barrel adaptor 230 that is adapted for attachment to a liquid spray gun platform, an air cap 240 adapted for attachment over the barrel adaptor 230, and a nozzle tip 250 that can be attached to the barrel adaptor 230 using, in the depicted embodiment, a threaded connection to a nozzle port 232 on the barrel adaptor 230. The barrel adaptor 230, air cap 240, and nozzle tip 250 of the spray head assembly 220 preferably combine to form cavities that deliver the center air and the fan air in a substantially isolated manner through the spray head assembly.

The barrel adaptor 230 in the embodiment of FIGS. 15-16 includes a threaded connector 239 that is adapted to attach to conventional liquid spray guns such as, e.g., those described in U.S. Pat. No. 6,793,155 (Huang); etc. As one example, the spray head assembly 220 may be used in conjunction with, e.g., a DeVilbiss GTI spray gun (available from Illinois Tool Works, Inc.).

In the embodiment depicted in FIGS. 15-16, the barrel adaptor 230 includes features that replace both the nozzle B and the ring A of the prior art spray head assembly depicted in FIGS. 12-14—except that the barrel adaptor 230 does not include the actual liquid nozzle opening through which liquid being delivered by the spray gun passes. Rather, the nozzle tip 250 includes the liquid nozzle opening 252 and is attached to a liquid nozzle port 232 on the barrel 230 and liquid being sprayed exits from the spray head assembly 220 through the liquid nozzle opening 252. As described herein, the nozzle tip 250 is removable from the barrel adaptor for cleaning and/or replacement.

The air cap 240 that is provided as a part of the illustrative embodiment of spray head assembly 220 is also depicted in FIGS. 15-16. The air cap 240 may preferably be attached to the spray gun over the barrel adaptor 230 in a manner that allows for rotation of the air cap 240 about the axis 200 relative to the barrel adaptor 230. Rotation of the air cap 240 may be used to change the orientation of the pattern of the atomized spray emitted from the spray head assembly 220 relative to the axis 200. In the depicted embodiment, the air cap 240 may be retained on a spray gun using a collar or ring such as, e.g., the retaining ring D depicted in the prior art spray gun of FIGS. 12-14. Any other suitable connection could be used, however, to hold the air cap 240 in place on a spray gun.

The air cap 240 includes a nozzle tip opening 249 that is large enough such that the nozzle tip 250 can be removed from the spray gun to which it is attached without requiring removal of the air cap 240. Such an arrangement may potentially offer the same functionality discussed above with respect to the embodiment depicted in FIGS. 1-8 in the embodiment of FIGS. 15-16. In addition, it is preferred that the nozzle tip 250 form a seal or otherwise close the nozzle tip opening 249 in the air cap 240 when installed on the barrel adaptor 230 in a manner similar to that described above in connection with the embodiment of FIGS. 1-8.

In some embodiments, it may be preferred that the nozzle tip opening 249, while large enough to allow removal and replacement of the nozzle tip 250, is too small to allow the barrel adaptor 230 to pass through the nozzle tip opening 249 in the air cap 240. The end result of such an arrangement is that removal of the barrel adaptor 230 from the spray gun requires removal of the air cap 240, while the nozzle tip 250 can be removed without requiring removal of either the barrel adaptor 230 or the air cap 240.

The barrel adaptor 230 includes features that define a liquid passageway 271 that terminates in the liquid nozzle port 232 through which the liquid to be sprayed exits the barrel 230 and enters the nozzle tip 250. Liquid enters the liquid passageway 271 in the barrel 230 through liquid port 274. The liquid passageway 271 defined in the barrel 230 is preferably isolated from the other features in the barrel 230. The liquid passageway 271 may preferably be sized to receive a needle (see, e.g. FIG. 1) that is capable of closing the liquid nozzle opening 252 when advanced towards the liquid nozzle opening 252 and opening the liquid nozzle opening 252 when retracted in the rearward direction away from the liquid nozzle opening 252.

The openings 234 in the barrel adaptor 230 deliver the center air exiting a barrel cavity in the spray gun platform (that is defined, at least in part, by the barrel adaptor 230) to a nozzle cavity 235 formed between the air cap 240 and the front wall 236 of the barrel adaptor 230. Air entering the nozzle cavity 235 flows through the nozzle cavity 235 until it exits the nozzle cavity 235 though a center air outlet 254 formed around the nozzle tip 250. In the depicted embodiment, the nozzle cavity 235 forms at least a portion of what can be characterized as the center air chamber of the spray head assembly 220, with the center air chamber terminating at the center air outlet 254 formed in the nozzle tip 250. The center air outlet 254 preferably surrounds the liquid nozzle opening 252 such that the center air passing through the center air outlet 254 can form the liquid passing through the liquid nozzle opening 252 into a generally conical stream.

The air cap 240 defines a nozzle cavity 235 at the front wall 236 of the barrel 230. Although not shown in the cross-sectional view of FIG. 15, the air cap 240 may also define optional cavities that, taken together, make up a portion of an optional fan air chamber in the spray head assembly 220. Any such fan air chamber would extend into the optional pair of air horns 243*a* and 243*b* and fan air exiting from such openings could be used to change the shape of the stream of liquid to form a desired spray pattern as described herein and in other documents identified herein. Air caps having fan air chamber passages and air horns are described herein in connection with the embodiment of FIGS. 1-8, in the prior art spray head assembly of FIGS. 12-14, and in at least some of the patent documents identified above.

As discussed herein, the nozzle tip 250 is removably attached to the barrel 230 over the liquid nozzle port 232. In the depicted embodiment, the nozzle tip 250 may be attached to the liquid nozzle port 232 by a threaded attachment as shown where the nozzle port 232 forms the male part while the nozzle tip 250 forms the female part of the connection, while in other embodiments that arrangement may be reversed. As discussed herein, any suitable attachment mechanism may be used to removably attach the nozzle tip 250 to the nozzle port 232. For example, in some embodiments, the nozzle tip 250 may be attached to the air cap 240 as discussed in connection with the embodiment depicted in FIG. 11.

The removable nozzle tips and spray head assemblies described herein may be used with a variety of liquid spray guns and spray gun platforms. In some embodiments, the liquid spray guns and spray gun platforms may be commonly referred to as gravity-fed spray guns (where the liquid to be sprayed is fed under gravity to the spray head assembly), siphon-fed spray guns (where the liquid to be sprayed is siphoned into the spray head assembly from a reservoir), and/or pressure-fed spray guns (where the liquid to be sprayed is fed under pressure from the reservoir into the spray head assembly). Further, auxiliary components that may be used in connection with the spray guns, spray gun platforms, and spray head assemblies discussed herein, and their respective methods of use, may be described in more detail in, e.g., U.S. Pat. No. 6,820,824 (Joseph et al.); U.S. Pat. No. 6,971,590 (Blette et al.); U.S. Pat. No. 7,032,839 (Blette et al.); U.S. Pat. No. 7,201,336 (Blette et al.); U.S. Pat. No. 7,484,676 (Blette et al.), and in U.S. Patent Application Publication Nos. 2004/0140373 (Joseph et al.); 2006/0065761 (Joseph et al.) and 2006/0102550 (Joseph et al.), etc.

The complete disclosure of the patents, patent documents, and publications cited herein are incorporated by reference in their entirety (to the extent that those teachings do not conflict with the explicit descriptions found herein) as if each were individually incorporated.

Illustrative embodiments of liquid spray guns, liquid spray gun platforms, and liquid spray head assemblies and methods of using them are discussed and reference has been made to possible variations. These and other variations, combinations, and modifications will be apparent to those skilled in the art without departing from the scope of the invention, and it should be understood that this invention is not limited to the illustrative embodiments set forth herein. Rather, the invention is limited only by the claims provided below, and equivalents thereof.

What is claimed is:

1. An integral, one-piece nozzle tip for a spray gun having an air cap, the integral one-piece nozzle tip comprising a spray axis;

a nozzle body comprising a nozzle outlet end and a liquid nozzle opening surrounding the spray axis;

a flange attached to the nozzle body by a support member, the flange comprising a flange outer edge a flange aperture surrounding the spray axis and surrounding the nozzle outlet end such that a center air outlet is defined between the flange aperture and the nozzle outlet end, the center air outlet and the liquid nozzle opening being fixed in relation to one another about the spray axis, wherein the integral, one-piece nozzle tip is adapted for installation at a nozzle tip opening of the air cap of the spray gun such that the flange outer edge provides a seal at an interface with an inner edge of the nozzle tip opening of the air cap to restrict air from exiting the interface, such that a center air flow is preferentially directed through the center air outlet to exit the spray gun.

2. The nozzle tip of claim 1 wherein the nozzle outlet end comprises a cylinder and the flange aperture is circular, such that the center air outlet is an annulus, the center air outlet and the liquid nozzle opening being fixed in concentric relation to one another about the spray axis.

3. A kit comprising the nozzle tip of claim 1, wherein the kit further comprises a plurality of the nozzle tips, and wherein at least two nozzle tips of the plurality of nozzle tips comprise center air outlets having different dimensions.

4. A kit comprising the nozzle tip of claim 1, wherein the kit further comprises a plurality of the nozzle tips, and wherein at least two nozzle tips of the plurality of nozzle tips comprise liquid nozzle openings having different dimensions.

5. A kit according to claim 4, wherein each nozzle tip of the plurality of nozzle tips comprises a threaded connection at the inlet end of the nozzle body.

6. A kit comprising the nozzle tip of claim 1, wherein the kit further comprises a plurality of the nozzle tips, and wherein at least two nozzle tips of the plurality of nozzle tips comprise liquid nozzle openings having different dimensions and center air outlets having different dimensions.

* * * * *